US010245878B2

(12) United States Patent
Franco

(10) Patent No.: US 10,245,878 B2
(45) Date of Patent: Apr. 2, 2019

(54) TABLET WITH INTERCONNECTION FEATURES

(71) Applicant: COMSERO, INC., Broomfield, CO (US)

(72) Inventor: Anthony Franco, Broomfield, CO (US)

(73) Assignee: COMSERO, INC., Broomfield, CO (US)

( * ) Notice: Subject to any disclaimer, the term of this patent is extended or adjusted under 35 U.S.C. 154(b) by 0 days.

(21) Appl. No.: 15/669,770

(22) Filed: Aug. 4, 2017

(65) Prior Publication Data

US 2017/0326904 A1 Nov. 16, 2017

Related U.S. Application Data

(62) Division of application No. 14/444,663, filed on Jul. 28, 2014, now Pat. No. 9,809,049.

(Continued)

(51) Int. Cl.

| | |
|---|---|
| ***B43K 23/00*** | (2006.01) |
| ***B43L 1/00*** | (2006.01) |
| ***G09F 7/00*** | (2006.01) |
| ***B43K 8/00*** | (2006.01) |
| ***B43K 23/12*** | (2006.01) |
| ***B43K 25/02*** | (2006.01) |
| ***B43L 1/04*** | (2006.01) |
| ***B43L 1/12*** | (2006.01) |
| ***B43L 19/00*** | (2006.01) |

(Continued)

(52) U.S. Cl.

CPC ..... *B43K 23/002* (2013.01); *B43K 8/003* (2013.01); *B43K 23/001* (2013.01); *B43K 23/12* (2013.01); *B43K 25/02* (2013.01); *B43K 25/022* (2013.01); *B43L 1/00* (2013.01); *B43L 1/008* (2013.01); *B43L 1/04* (2013.01); *B43L 1/045* (2013.01); *B43L 1/12* (2013.01); *B43L 1/123* (2013.01); *B43L 19/0068* (2013.01); *B43L 19/04* (2013.01); *B43L 21/00* (2013.01); *B43L 21/04* (2013.01); *G09F 7/00* (2013.01); *G09F 7/04* (2013.01); *G09F 7/20* (2013.01); *Y10T 29/49716* (2015.01)

(58) Field of Classification Search

None

See application file for complete search history.

(56) References Cited

U.S. PATENT DOCUMENTS 3,531,898 A 10/1970 Facemire
3,909,003 A 9/1975 Rabinovich (Continued)

OTHER PUBLICATIONS

International Search Report and Written Opinion for International (PCT) Patent Application No. PCT/US14/58237, dated Feb. 25, 2015 12 pages.

(Continued)

*Primary Examiner* — James Hull

(74) *Attorney, Agent, or Firm* — Rocky Mountain Patent, LLC.

(57) ABSTRACT

The present invention provides tablets with interconnection features and a system of multiple tablet assemblies removably interconnected to one another. The tablets may be removably mounted to a vertical surface or positioned on a horizontal surface. Features of the present invention allow a user to remove or move one tablet from the system without disrupting or moving the other tablets.

2 Claims, 14 Drawing Sheets

Related U.S. Application Data

(60) Provisional application No. 61/886,768, filed on Oct. 4, 2013.

(51) Int. Cl.

| | |
|---|---|
| ***B43L 19/04*** | (2006.01) |
| ***B43L 21/00*** | (2006.01) |
| ***B43L 21/04*** | (2006.01) |
| *G09F 7/04* | (2006.01) |
| *G09F 7/20* | (2006.01) |

(56) References Cited

U.S. PATENT DOCUMENTS

| | | | |
|---|---|---|---|
| 3,914,890 | A | 10/1975 | Behlen, Jr. |
| 4,146,976 | A | 4/1979 | Zambiasi |
| 4,581,483 | A | 4/1986 | Ralston |
| 4,716,693 | A | 1/1988 | Webster |
| 4,911,536 | A | 3/1990 | Ditzik |
| 5,269,083 | A | 12/1993 | Vampatella et al. |
| 5,670,992 | A | 9/1997 | Yasuhara et al. |
| 5,775,919 | A | 7/1998 | Gardner |
| 5,847,698 | A | 12/1998 | Reavey et al. |
| 6,011,545 | A | 1/2000 | Henderson et al. |
| 6,139,331 | A | 10/2000 | Owen |
| 6,266,045 | B1 | 7/2001 | Myerson et al. |
| 6,313,828 | B1 | 11/2001 | Chombo |
| 6,780,019 | B1 | 8/2004 | Ghosh et al. |
| 6,788,297 | B2 | 9/2004 | Itoh et al. |
| D534,904 | S | 1/2007 | Crawford |
| 7,170,468 | B2 | 1/2007 | Knopf |
| 7,354,273 | B2 | 4/2008 | Donelan |
| D590,123 | S | 4/2009 | Hermans |
| D600,874 | S | 9/2009 | Hermans |
| D600,875 | S | 9/2009 | Hermans |
| D602,147 | S | 10/2009 | Lucero |
| 7,602,379 | B2 | 10/2009 | Lemon |
| 7,604,481 | B2 | 10/2009 | Owen et al. |
| 7,663,607 | B2 | 2/2010 | Hotelling et al. |
| 7,726,406 | B2 | 6/2010 | Xu |
| 7,738,245 | B1 | 6/2010 | Stifal |
| D626,407 | S | 11/2010 | Tedesco et al. |
| 7,864,517 | B2 | 1/2011 | Miller et al. |
| 7,925,996 | B2 | 4/2011 | Hofmeister et al. |
| 7,954,064 | B2 | 5/2011 | Forstall et al. |
| 8,046,706 | B2 | 10/2011 | Lee et al. |
| 8,108,791 | B2 | 1/2012 | Wang et al. |
| 8,295,037 | B1 | 10/2012 | Buuck et al. |
| 8,368,616 | B1 | 2/2013 | Harris |
| 8,452,600 | B2 | 5/2013 | Fleizach |
| 8,529,271 | B2 | 9/2013 | Savatovich |
| D700,151 | S | 2/2014 | Hochman et al. |
| 8,840,284 | B1 | 9/2014 | Hochman et al. |
| D747,955 | S | 1/2016 | Franco |
| 9,809,049 | B2 | 11/2017 | Franco |
| 2002/0130836 | A1 | 9/2002 | Ohmori et al. |
| 2003/0222878 | A1 | 12/2003 | Lin |
| 2004/0012558 | A1 | 1/2004 | Kisuki et al. |
| 2004/0046705 | A1 | 3/2004 | Masazumi et al. |
| 2005/0191611 | A1 | 9/2005 | Owen et al. |
| 2006/0007173 | A1 | 1/2006 | Tsai et al. |
| 2006/0038795 | A1 | 2/2006 | Lee |
| 2006/0109257 | A1 | 5/2006 | Ambasz |
| 2006/0143964 | A1* | 7/2006 | Chatellier ..... A47G 1/065 40/711 |
| 2006/0187142 | A1 | 8/2006 | Lesniak |
| 2006/0214919 | A1 | 9/2006 | Moore et al. |
| 2006/0236572 | A1 | 10/2006 | Ko |
| 2006/0257198 | A1 | 11/2006 | Roeloffs |
| 2007/0008294 | A1 | 1/2007 | Huang et al. |
| 2007/0118671 | A1 | 5/2007 | Ganti |
| 2007/0144046 | A1 | 6/2007 | Hardt, II |
| 2007/0182663 | A1 | 8/2007 | Biech |
| 2007/0204500 | A1 | 9/2007 | Splittgerber |
| 2008/0120922 | A1 | 5/2008 | Sullivan et al. |
| 2008/0229640 | A1* | 9/2008 | Saunders-Singer ..... A47F 7/146 40/711 |
| 2008/0248456 | A1 | 10/2008 | Cheris et al. |
| 2009/0193629 | A1 | 8/2009 | Suenaga |
| 2009/0250575 | A1 | 10/2009 | Fullerton et al. |
| 2009/0266721 | A1 | 10/2009 | Bala |
| 2009/0296331 | A1 | 12/2009 | Choy |
| 2010/0011644 | A1 | 1/2010 | Kramer |
| 2010/0045611 | A1 | 2/2010 | Nelson et al. |
| 2010/0068422 | A1 | 3/2010 | Keyes |
| 2010/0245221 | A1 | 9/2010 | Khan |
| 2011/0042541 | A1 | 2/2011 | Spencer et al. |
| 2011/0128216 | A1 | 6/2011 | Renwick |
| 2012/0038570 | A1 | 2/2012 | Delaporte |
| 2012/0064503 | A1 | 3/2012 | Helton et al. |
| 2012/0084706 | A1 | 4/2012 | Sirpal et al. |
| 2012/0124490 | A1 | 5/2012 | Sirpal et al. |
| 2012/0171656 | A1 | 7/2012 | Shen |
| 2012/0194455 | A1 | 8/2012 | Hsu et al. |
| 2012/0268399 | A1 | 10/2012 | Cheng et al. |
| 2012/0275842 | A1 | 11/2012 | Nagao |
| 2013/0026634 | A1 | 1/2013 | Lee et al. |
| 2013/0074299 | A1 | 3/2013 | Rojdev |
| 2013/0157246 | A1 | 6/2013 | Shapiro |
| 2013/0164730 | A1 | 6/2013 | Gustafson et al. |
| 2013/0224722 | A1 | 8/2013 | Petak |
| 2013/0224723 | A1 | 8/2013 | Gonzales et al. |
| 2014/0377736 | A1 | 12/2014 | Essen et al. |
| 2016/0073796 | A1 | 3/2016 | Nesbitt |

OTHER PUBLICATIONS

International Preliminary Report on Patentability for International (PCT) Patent Application No. PCT/US2014/058237, dated Apr. 14, 2016 10 pages.

Official Action for U.S. Appl. No. 14/444,663, dated Mar. 31, 2016, 14 pages.

Notice of Allowance for U.S. Appl. No. 14/444,663, dated Jul. 10, 2017, 10 pages.

Notice of Allowance for U.S. Appl. No. 29/490,321, dated Sep. 11, 2015, 9 pages.

Nov. 30, 2018 Office Action issued in U.S. Appl. No. 16/138,487.

* cited by examiner

TABLET WITH INTERCONNECTION FEATURES

RELATED APPLICATIONS

This application is a Divisional application of and claims the benefit of U.S. patent application Ser. No. 14/444,663, filed Jul. 28, 2014, which claims the benefit of U.S. Provisional Patent Application No. 61/886,768, filed Oct. 4, 2013, entitled "Erasable Writing Tablet With Interconnection Features," which are hereby incorporated by reference in their entireties.

FIELD OF THE INVENTION

The present invention relates to moveable and interconnectable substrates that allow users to mark thereon or display items therein and, more specifically, to erasable writing tablets with interconnection features.

BACKGROUND OF THE INVENTION

Dry erase boards are known and typically include a board or substrate that is coated with an enamel, film, ultraviolet cured liquid, liquid varnish, or porcelain finish. Specially designed markers are used to write on the substrate. While the ink of the marker dries on the substrate, the ink does not bond to the substrate surface and the writing can be easily removed with a soft eraser, cloth, finger, etc.

However, improved rewritability performance of other articles with writing surfaces is desired. A persistent challenge with such articles which has not yet been satisfactorily met is that the writing surfaces do not accept writing from a variety of writing instruments, do not erase cleanly and easily, and tend to degrade when ink is erased. A continuing need exists to provide such articles with rewritable surfaces thereon that exhibit improved rewritability.

Other disadvantages of traditional dry erase boards are the inability to easily move writing on the board to another location on the board and the inability to easily apply graphics to or change graphics on the substrate. For example, some dry erase boards are provided with horizontal lines for writing purposes. However a user may not want lines on the board at all times.

Additionally, the use of erasable boards for presentations is generally known. Such boards include chalkboards, such as blackboards and greenboards, and whiteboards. For ease in presenting and storing data, individuals have come to rely on several boards instead of just one board fastened to a wall.

The prior art has presented several options for a user of erasable boards. In U.S. Pat. No. 3,531,898 to Facemire, which is incorporated by reference herein in its entirety, a plurality of display boards is suspended for sliding along a track. In U.S. Pat. No. 3,914,890 to Behlen, Jr., which is incorporated by reference herein in its entirety, a plurality of display panels or signs are mountable within tracks formed in parallel upstanding side posts. In U.S. Pat. No. 4,716,693 to Webster, which is incorporated by reference herein in its entirety, the structure includes details of roller assemblies used for movably supporting a sign or panel along a track. In U.S. Pat. No. 6,139,331 to Owen, which is incorporated by reference herein in its entirety, a board base apparatus provided both storage and display of board panels using slots or tracks.

Each of these prior art storage and display units includes tracks in order to store the erasable boards. However, inserting and removing the boards from the units can be difficult because each board must fit into a narrow track in order to properly hold the board. Additionally, the removable boards can only be used when tracks are present. Thus, the erasable boards are not transportable to locations without the tracks. Further, these units are difficult to work with and are expensive.

In many facilities, providing writing and demonstration tools in the walls of existing rooms may not be feasible due to cost or structural constraints. Thus in order to provide such tools, free-standing whiteboards may be used. These tools may take up space and/or be cumbersome to use and then store.

SUMMARY OF THE INVENTION

These and other needs are addressed by the various embodiments and configurations of the present invention. This invention relates to a novel system, device, and method for providing tablets with interconnection and/or mounting features. Embodiments of the present invention relate to a system of multiple tablets and a system for displaying the multiple tablets. More particularly, embodiments of the present invention relate to an erasable writing tablet system that provides for the easy interconnection of the tablets, the quick rearrangement of the tablets without the use of slots or tracks, the easy interchangeability of writing surfaces and designs thereon, and an innovative wall mounting system.

Features of the present invention may be employed in a wide range of uses, including the presentation of analog and digital material. Although the invention generally relates to writing tablets, such as dry erase boards, with interconnection features, the invention and features described herein could easily be implemented on chalk boards, electronic writing tablets, picture frames, clocks, artwork, signs, and other presentation media. The term "tablet" may be used interchangeable with the term "board" herein.

It is thus one aspect of various embodiments of the present invention to provide a system of tablets, such as erasable writing tablets, which can be interconnected with, disconnected from, and rearranged with respect to one another. A user may write on one board, write on another board, and then interconnect the two boards together using the boards' interconnection means. The interconnection means may be magnets, hooks, hook and loop material, straps, clips, buckles, hinges (such as a barrel hinge, living hinge, single continuous hinge, or piano hinge), female and male locking catches, or any interconnection mechanism known in the art. Further, the tablets may be assembled in any configuration on a vertical plane (e.g., wall surface) or a horizontal plane (e.g., table surface).

It is another aspect of embodiments of the present invention to provide a system of tablets that can be interconnected to one another back-to-back and/or side-by-side on either a horizontal surface or a vertical surface. A further aspect includes providing a system of tablets and mounting mechanisms that allow multiple tablets to be interconnected to a vertical wall such that one tablet can be removed from the wall and/or moved to a new position on the wall without removing or moving the other tablets. Thus, if the system includes nine tablets in a square arrangement, the center tablet must be removable and reattachable without removing or moving the other eight tablets.

One aspect of embodiments of the present invention is to provide a tablet system that allows a user to easily and quickly reorganize the tablets with respect to one another such that the user may move around the tablets as he sees fit.

Thus, if one aspect or one section of the entire board or presentation makes more sense in a different location, then the user may easily move only the one or more tablets with that section/aspect to a different location relative to the other tablets.

Another aspect of embodiments of the present invention is to promote collaboration among groups by allowing multiple people to contribute small ideas or small parts of a big idea and combine those small ideas into one big idea. Thus, each person may write or draw his/her small part on an individual tablet and then all of the tablets can be combined and arranged to form one big idea or one big picture.

It is another aspect of some embodiments of the present invention to provide a system of tablets that may be easily mounted on a wall and the tablets may be interconnected to one another on the wall. Thus, the tablets may be positioned on a wall or taken off of the wall individually to allow a user to write on one or more of the tablets. Additionally, the tablets may be rearranged on the wall with respect to one another.

In still another aspect of the embodiments of the present invention, a system of erasable writing tablets is provided where the writing tablets are releasably adhered to a wall. Accordingly, the tablets are positioned substantially parallel to the wall, if the wall is flat.

It is one aspect of the embodiments of the present invention to provide tablets that, when interconnected, are properly aligned. Thus, the interconnection means provided on the tablets allow for accurate alignment of the tablets. Additionally, the mounting brackets can have mechanisms to ensure the proper alignment of the mounting brackets.

Another aspect of various embodiments of the present invention is to provide a mounting system, which may be a plurality of mounting assemblies, that is aesthetically pleasing when it is not covered by tablets. Thus, the mounting assemblies can form a design when they are interconnected together. Additionally, one mounting assembly is also aesthetically pleasing when it is mounted alone. Further, the mounting assemblies can be different colors or have different designs on their upper or front surfaces.

One aspect of embodiments of the present invention is to provide a plurality of mounting assemblies, which can interconnect to a plurality of tablets, that is easy to install, can be installed almost anywhere, and is easily movable to different locations.

It is a further aspect of embodiments of the present invention to provide an infinitely expanding system of mounting assemblies and tablets. Accordingly, one mounting assembly can be secured to a surface to interconnect with one tablet, or multiple mounting assemblies can be secured to a surface to interconnect with multiple tablets. Further, the system may start with a few mounting assemblies and tablets and at a later time, more mounting assemblies and tablets can be added to the system.

It is one aspect of embodiments to provide a mounting assembly system comprising a plurality of mounting assemblies that can interconnect to different items. Thus, for example, artwork, clocks, cork boards, pictures, photographs, calendars, white boards, chalkboards, games, signs, and the like, can be hung or fixed to the mounting assemblies. Additionally, multiple tablets or items can interconnect to multiple mounting assemblies or one large item (e.g., a large piece of art) can interconnect to multiple mounting assemblies.

Another aspect of embodiments of the present invention is to provide a tablet with interconnection means to fasten or hold together two tablets back-to-back such that materials and objects can be contained between the two interconnected tablets. Thus, one aspect of embodiments of the present invention is to provide erasable writing tablets with locking mechanisms to secure two or more tablets together for travel. The locking mechanisms may secure multiple tablets together, either back-to-back or stacked one on top of another. The locking mechanism allows the user to unlock the locking mechanism and separate the tablets for presentation and/or use.

It is another aspect of embodiments to provide a tablet with a frame and a tray (i.e., cover, top portion, upper portion, or overmold) that are easily interconnected and detachable from one another such that various trays can be used or various inserts can be inserted between the tray and frame. Thus, different colored frames can be used with an at least partially transparent tray such that the frame can be seen through the tray. Alternatively, frames with different upper surfaces (e.g., different texture, writing surface, design, transparency, etc.) or different designs, such as lines, graphs, charts, calendars, plain, etc.) can be used with the base. Further, the removable tray allows different inserts, such as paper with different designs such as lines, graph paper, tables, clocks, calendars, etc., to be used with the base. The inserts can be seen through the tray as long as the tray is at least partially transparent.

In one embodiment of the present invention, the tablets are dry-erase boards (also known as "markerboards," "whiteboards," or "dry-wipe boards") with a smooth, glossy surface on one side (for example, the upper side) of the board. The upper surface of the tablet can either be clear or colored, for example, white, so a user can mark or write on the board's upper surface. If the upper surface is clear, then either the frame or the insert can be white or another solid color so a user can mark or write on the board's upper surface. Whiteboards operate analogously to chalkboards in that they allow markings to temporarily adhere to the surface of the board. These markings are removed more easily on whiteboards than chalkboards. Dry-erase boards have become rather common in most work environments, classrooms, and the like, due to their less messy and easily erasable writing surfaces. However, unlike a chalkboard, and the need for chalk to make markings on the board, the dry-erase board uses easily erasable markers to make marks on the board. The use of an erasable, non-permanent marker allows the user to make frequent changes and alterations to the written form without the hassle of chalky residue normally accompanying chalkboards. Dry-erase boards may be constructed with a plurality of different materials, but are typically made of porcelain enameled steel which provides greater durability, but is typically heavy and difficult to move.

A standing challenge for dry-erase articles is to find surfaces that can be easily cleaned, resist staining when written on with permanent markers, can be easily erased when written on with conventional dry-erase markers, and are durable. Dry-erase writing that is not removable by a dry eraser is commonly called ghosting. Different surfaces provide different amounts of ghosting. Thus, some embodiments of the present invention include glass, graphene, or porcelain surfaces for the tablet's upper surface, (i.e., the writing surface) because these surfaces are non-porous so they are easily written on with dry-erase markers and then easily erased after a short time. In other embodiments, the tablet's upper surface is a polymer, such as acrylic, abrasion resistant acrylic, or polycarbonate.

According to one embodiment of the present invention, the writing surface of the tablet may include a magnetic re-writable surface or a flexible magnetic dry-erase surface. Thus, the magnetic writing surface could be a large magnet that attaches to and detaches from the tablet base such that users could remove the magnetic writing surface to write on it, then reattach it to the board for presentation purposes.

One embodiment of the present invention includes one writing tablet with a calendar displayed on the re-writable surface. In another embodiment, one writing tablet has a blank writing surface, a grid, or any other preferred writing surface.

Some embodiments of the present invention include a clear window and a panel coupled to the window to define an opening between the clear window and the panel for inserting a document thereto via one side of the clear window. Alternatively, the tablet may have a clear, detachable tray that fits over a frame such that documents and designs can be inserted between the tray and the frame.

In one embodiment of the present invention, the tablet includes a metal reinforced hole for hanging the tablet on a hook or string. The tablet can have other mounting mechanisms to mount or hang the tablet. Some embodiments of the present invention also include handles that can be removably interconnected to any or all of the tablets. The handle can also clampingly secure a wall mounting bracket to the tablet, thereby permitting secure fixation of the tablet on a wall.

Further embodiments of the present invention include a utensil pocket coupled to the back or underside of the tablet. The pocket may be secured to the back of the tablet or may be releasably interconnected to the back of the tablet. Alternatively, the back of the tablet can include two or more straps for storing other items on the underside of the tablet. In some embodiments, the tablet includes spaces or channels to engage clips of various shapes. The shape of the clip will determine what accessories and materials the clips can hold on an underside of the tablet or between two tablets interconnected back-to-back. In various embodiments, the tablets comprise at least one surface with an array of touch fastening elements allowing the backs of the tablets to be removably engageable to one another.

In one embodiment of the present invention, a selectively movable writable surface is provided, including a flat support surface and a re-adherable writing board releasably interconnected thereto. The writing board includes a flexible rectangular board having a substantially blank front surface and a rear surface within an outer boundary. The flexible board is substantially flat in an unflexed configuration and the front surface is a polyethylene terephthalate dry-erase surface.

In various embodiments the tablet assembly comprises a tablet that can interconnect to and detach from a mounting assembly. The tablet comprises a tray with an upper surface, a frame, and an insert. The frame has a brick connection rear surface and a plurality of magnets. The mounting assembly has a mounting bracket, indentions, protuberances, lips, and ferrous metal rivets. The frame interconnects to the mounting assembly via the magnets attracting and interconnecting to the ferrous metal rivets, which align with the magnets. The magnets of the tablet allow the tablet to interconnect to another tablet side-by-side or back-to-back and interconnect to the mounting assembly. Additionally, the tablet can interconnect to any ferrous metal surface.

In one embodiment, the tablets comprise magnets to releasably interconnect two or more tablets to one another back-to-back or side-by-side. In additional embodiments, the sides of the tablets also comprise recesses, slots, or indentations to further align and interconnect multiple tablets to one another side-by-side.

Some embodiments of the tablet include a rewritable surface comprising a coating of hydrophilic silane or a hydrophilic water soluble polymer with hydroxyl groups which is crosslinked or chemically reacted to the surface. In one embodiment, a method of treating a writing surface to impart rewritable properties thereto is provided. The method includes applying a hydrophilic coating composition to the surface to bond to the —OH groups on the surface, where the hydrophilic coating composition includes alkoxysilane groups and/or silanol-functional groups bonded to a zwitterion, anion, cation, carbohydrate, or a hydrophilic polymeric moiety. The hydrophilic coating composition can also contain lithium silicate, sodium silicate, potassium silicate, or combinations thereof. The method further includes drying the hydrophilic coating composition to form a hydrophilic coating including at least a monolayer of the hydrophilic compound bonded to the writing surface through siloxane bonds.

In one embodiment of the present invention, the tablets can have electronic components such that the information written on the tablets can be transferred to a computer or computing device or to a larger screen. Thus, the writing tablets may accept input data through a touch-sensitive surface. In an alternate or additional embodiment, the tablet with electrical components can display images or information on the tablet's upper surface.

In some embodiments, the electronic tablet comprises a processor, memory, an input device (which can be a touch-screen display surface configured to receive touch input), a display to display content, and a power source (which can be a battery). The tablet can further include data storage, software, a user interface, an input device, an output device, a communication network, such as Bluetooth or WiFi, and/or a communication interface for communicating with another tablet or computing device and/or the communication network. The display can include an overlayed electronic skin. The display can include an outer transparent display surface and can be placed in a dark state or in a bright state similar to the display described in U.S. Patent Publication No. 2010/0245221 to Khan, which is incorporated by reference herein in its entirety.

In further embodiments, the processor can include any processor capable of performing instructions encoded in software or firmware. Further, the processor can be provided to execute instructions contained within the memory and/or data storage. The processor can comprise a controller or application specific integrated circuit (ASIC) having or capable of performing instructions encoded in logic circuits. The memory may be used to store programs or data, including data comprising content. As examples, the memory may comprise RAM, SDRAM, or other solid state memory. Alternatively or in addition, data storage may be provided. The data storage may generally include storage for programs and data.

In one embodiment, the tablet further includes an interactive electro-optic display device used in combination with a transparent graphics tablet device providing an electronic writing surface for an integrated display-tablet operation. A person using the tablet or tablet system can hand sketch, write, and draw onto an electronic writing surface, and the system converts this information to electrical signals for display on a viewing screen directly under the transparent graphic tablet.

In another embodiment, the tablets can comprise an elastic sleeve situated between two tablets positioned side-by-side to provide a housing for the flexible circuit connecting the two tablets. The flexible circuit interconnection mechanism may provide pathways for coupling the tablets and include an electrical conductor, an optical path, electromagnetic waveguides, fluidic channels, magnetic couplings, mechanical couplings, and so forth. A magnet can be positioned along the edge and back side of one side of the first tablet to provide a lock for both tablets when interconnected to a second magnet positioned on the edge and back side of the second tablet allowing the two tablets to snap together without extra, bulky hardware, such as mechanical hinges. Sensors can be positioned adjacent to the magnets to determine whether or not the tablets are interconnected and to determine how the tablets are arranged or interconnected to one another, i.e., which side of each tablet is connected to another tablet and where in the system of tablets each tablet is located.

In an alternate embodiment, there is not a physical connection between two tablets. Thus, the tablets can be charged and/or powered through the mounting assemblies. Additionally, the tablets can receive relevant data (e.g., position in a wall system) from the mounting assemblies or the tablets can self-actualize their positions using near field communication (NFC) or other wireless proximity sensors between the tablets.

In one embodiment, the tablets may comprise hinges, mini stands, flaps, hooks, straps, adjustable mounting brackets, or another positioning mechanism that allow one or more tablets to be positioned at an angle relative to a horizontal surface. Thus, the tablet may be positioned at an angle relative to a horizontal surface (e.g., a table top) for ease of viewing, similar to a case or a stand for an electronic reader that positions the reader in an upright position.

In one embodiment, the tablet may comprise a coupling mechanism that allows the rotation of each tablet relative to another tablet such that any angle between 0 degrees and 360 degrees can be achieved. In addition, the coupling mechanism can allow the angle to be maintained by a damping means. For example, two tablets coupled together can therefore be rotated with their positions maintained by the damping means such that the writing surfaces of both tablets face each other, or face outward and away from each other, as well as achieve any position in between.

In another embodiment, one side of the hinging mechanism may comprise a component with a larger outer perimeter that slides over a component with a smaller inner perimeter. A third locking component may also be present to secure the previous two components together, while allowing rotation of the tablets relative to each other. In one embodiment, the hinge may unclip to allow the two tablets to separate completely.

In some embodiments of the present invention, a tablet with interconnection features is provided comprising: a frame member comprising: a substantially smooth top side; a bottom side; two or more side walls, wherein an end of each side wall has a tapered bottom edge, a middle portion of each side wall has a substantially flat bottom edge, and each side wall has one or more magnetic housings; and two or more magnets, wherein each magnet is positioned within one magnetic housing; an overmold comprising: a substantially flat top side; two or more side walls; and a channel; and wherein the top side of the overmold is positioned adjacent to the bottom side of the frame member and the two or more side walls of the overmold are positioned adjacent to an inner surface of the two or more side walls of the frame member. In a further embodiment, the tablet is an erasable writing tablet, wherein the substantially smooth top side includes a writing surface.

In one embodiment, a system of using, arranging, and rearranging a plurality of erasable writing tablets is provided comprising: providing at least two erasable writing tablets, each erasable writing tablet comprising: a frame member with a substantially smooth top side having a writing surface, a bottom side, two or more side walls, two or more magnetic housings, and two or more magnets, wherein an end of each side wall has a tapered bottom edge and a middle portion of each side wall has a substantially flat bottom edge; an overmold having a substantially flat top side, two or more side walls, and a channel; and wherein the top side of the overmold is positioned adjacent to the bottom side of the frame member; and releasably interconnecting the at least two erasable writing tablets. In a further embodiment, one magnet in a first erasable writing tablet is a positively oriented magnet and one magnet in a second erasable writing tablet is a negatively oriented magnet, and wherein the positive y oriented magnet of the first erasable writing tablet is releasably interconnected to the negatively oriented magnet of the second erasable writing tablet.

In one embodiment a tablet assembly is provided comprising: a tablet comprising: a tray including: an upper surface; a bottom side; a first tray side wall; a first magnet in the first tray side wall; a second tray side wall; and a second magnet in the second tray side wall; and a frame including a first frame side wall and a second frame side wall, wherein the first tray side wall interconnects to the first frame side wall; and wherein the second tray side wall interconnects to the second frame side wall; a mounting assembly comprising: a mounting bracket including a first leg with a protuberance at an end of the first leg, a second leg with an indention at an end of the second leg, a first lip, and a second lip; a first rivet; and a second rivet; and wherein the first magnet of the tablet interconnects to the first rivet of the mounting assembly and the second magnet of the tablet interconnects to the second rivet of the mounting assembly.

In a further embodiment, the first lip of the mounting assembly extends upwardly from an upper surface of the mounting bracket and the second lip of the mounting assembly extends upwardly from an upper surface of the mounting bracket. Additionally, the frame of the tablet further comprises a first curved magnet holder to hold the first magnet and a second curved magnet holder to hold the second magnet, and wherein the first lip of the mounting assembly is curved to receive the first curved magnet holder and the second lip of the mounting assembly is curved to receive the second curved magnet holder. In one embodiment, a portion of the upper surface of the tray is a substantially smooth writing surface; the first tray side wall comprises a first protuberance and the second tray side wall comprises a second protuberance; or the first frame side wall comprises a third lip extending along the first frame side wall, and wherein the third lip receives a lower portion of the first tray side wall. In various embodiments, the first tray side wall comprises a first protuberance to interconnect the first tray side wall to the first frame side wall and the second tray side wall comprises a second protuberance to interconnect the second tray side wall to the second frame side wall. Further, the first frame side wall comprises a first aperture and the second frame side wall comprises a second aperture, and the first aperture of the first frame side wall receives the first protuberance of the first tray side wall to interconnect the first tray side wall to the first frame side wall and the second aperture of the second frame side wall receives the second protuberance of the second tray side wall to interconnect the second tray side wall to the second frame side wall. Alternatively, a lower portion of the first frame side wall curves inward toward a center of the frame and a lower portion of the second frame side wall curves inward toward the center of the frame. In an additional embodiment, the frame comprises a first magnet holder extending outwardly from the first frame side wall and a second magnet holder extending outwardly from the second frame side wall, and wherein the first magnet is positioned within the first magnet holder and the second magnet is positioned within the second magnet holder.

In various embodiment, an erasable writing tablet is provided comprising: a tray comprising: a substantially smooth upper surface having a writing surface; a bottom side; and two or more tray side walls; a frame comprising: a rib; two or more frame side walls, wherein each frame side wall has a magnet; and a lip in the two or more frame side walls, wherein the lip receives a lower portion of the two or more tray side walls; wherein the rib of the frame is positioned proximate to the bottom side of the tray; and wherein the two or more tray side walls interconnect to the two or more frame side walls. In a further embodiment, the rib of the frame extends from a side of the frame to an opposite side of the frame, wherein a first portion of the rib proximate to a center of the frame has a first height and a second portion of the rib proximate to the side of the frame has a second height, and wherein the first height is greater than the second height.

In some embodiments, the tablet has a crowned upper surface and the tablet further comprises a removable insert positioned between an upper surface of the rib of the frame and the bottom side of the tray. Additionally, each tray side wall can have a protuberance, and wherein each frame side wall has an aperture positioned above the magnet to receive the protuberance.

In one embodiment, an erasable writing tablet system is provided comprising: a first erasable writing tablet comprising: a tray comprising: a substantially smooth upper surface having a writing surface; a bottom side; and four tray side walls; a frame comprising: a rib; four frame side walls, wherein each frame side wall has a magnet; and a lip in the four frame side walls, wherein the lip receives a lower portion of the four tray side walls, wherein the rib of the frame is positioned proximate to the bottom side of the tray, and wherein the four tray side walls interconnect to the four frame side walls; a first side wall comprised of one of the four frame side walls and one of the four tray side walls; a second side wall comprised of one of the four frame side walls and one of the four tray side walls; a third side wall comprised of one of the four frame side walls and one of the four tray side walls; and a fourth side wall comprised of one of the four frame side walls and one of the four tray side walls; a second erasable writing tablet comprising: a tray comprising: a substantially smooth upper surface having a writing surface; a bottom side; and four tray side walls; a frame comprising: a rib; four frame side walls, wherein each frame side wall has a magnet; and a lip in the four frame side walls, wherein the lip receives a lower portion of the four tray side walls, wherein the rib of the frame is positioned proximate to the bottom side of the tray, and wherein the four tray side walls interconnect to the four frame side walls; a first side wall comprised of one of the four frame side walls and one of the four tray side walls; a second side wall comprised of one of the four frame side walls and one of the four tray side walls; a third side wall comprised of one of the four frame side walls and one of the four tray side walls; and a fourth side wall comprised of one of the four frame side walls and one of the four tray side walls; wherein the magnet in the frame side wall of the first side wall of the first erasable writing tablet interconnects to the magnet in the frame side wall of the first side wall of the second erasable writing tablet to interconnect the first side wall of the first erasable writing tablet to the first side wall of the second erasable writing tablet.

In a further embodiment, the erasable writing tablet system is provided wherein the rib of the frame of the first erasable writing tablet extends from a side of the frame of the first erasable writing tablet to an opposite side of the frame of the first erasable writing tablet, wherein a first portion of the rib proximate to a center of the frame of the first erasable writing tablet has a first height and a second portion of the rib proximate to the side of the frame of the first erasable writing tablet has a second height, and wherein the first height is greater than the second height such that the first erasable writing tablet has a crowned upper surface. In alternate or additional embodiments of the present invention, the first erasable writing tablet comprises a removable insert positioned between an upper surface of the rib of the frame and the bottom side of the tray, and wherein the second erasable writing tablet further comprises a removable insert positioned between an upper surface of the rib of the frame and the bottom side of the tray. In one embodiment of present invention, the first erasable writing tablet comprises an electronic display for displaying content, a processor, memory, and a communication interface to connect to a communication network, wherein the electronic display has a touch-sensitive surface, and wherein the second erasable writing tablet further comprises an electronic display for displaying content, a processor, memory, and a communication interface to connect to the communication network, wherein the electronic display has a touch-sensitive surface, wherein the first erasable writing tablet is capable of sending information over the communication network to the second erasable writing tablet.

In one embodiment, a system of using, arranging, and rearranging a plurality of tablet assemblies is provided comprising: providing a first tablet including an upper surface, a bottom surface, a first side comprising a first magnet, a second side comprising a second magnet, a third side comprising a third magnet, and a fourth side comprising a fourth magnet; providing a second tablet including an upper surface, a bottom surface, a first side comprising a first magnet, a second side comprising a second magnet, a third side comprising a third magnet, and a fourth side comprising a fourth magnet; providing a first mounting assembly including a first leg with a first rivet, a second leg with a second rivet, a third leg with a third rivet, and a fourth leg with a fourth rivet; providing a second mounting assembly including a first leg with a first rivet, a second leg with a second rivet, a third leg with a third rivet, and a fourth leg with a fourth rivet; releasably interconnecting the first tablet to the first mounting assembly by interconnecting the first magnet of the first tablet to the first rivet of the first mounting assembly, interconnecting the second magnet of the first tablet to the second rivet of the first mounting assembly, interconnecting the third magnet of the first tablet to the third rivet of the first mounting assembly, and interconnecting the fourth magnet of the first tablet to the fourth rivet of the first mounting assembly; and releasably interconnecting the second tablet to the second mounting assembly by interconnecting the first magnet of the second tablet to the first rivet of the second mounting assembly, interconnecting the second magnet of the second tablet to the second rivet of the second mounting assembly, interconnecting the third magnet of the second tablet to the third rivet of the second mounting assembly, and interconnecting the fourth magnet of the second tablet to the fourth rivet of the second mounting assembly.

In further embodiment, the system further comprises releasably interconnecting the first tablet to the second tablet by interconnecting the first magnet of the first tablet to the first magnet of the second tablet. In various embodiments, the first leg of the first mounting assembly comprises a first protuberance, the second leg of the first mounting assembly comprises a first indention, the third leg of the first mounting assembly comprises a second protuberance, and the fourth leg of the first mounting assembly comprises a second indention, and wherein the first leg of the second mounting assembly comprises a first indention to receive the first protuberance of the first mounting assembly, the second leg of the second mounting assembly comprises a first protuberance which is received by the first indention of the first mounting assembly, the third leg of the second mounting assembly comprises a second indention to receive the second protuberance of the first mounting assembly, and the fourth leg of the first mounting assembly comprises a second protuberance which is received by the second indention of the first mounting assembly. Additionally, the system further comprises releasably interconnecting the first mounting assembly to the second mounting assembly by inserting the first protuberance of the first mounting assembly into the first indention of the second mounting assembly. The system can further comprises: providing a third mounting assembly; releasing the second tablet from the second mounting assembly; releasably interconnecting the second tablet to the third mounting assembly; securing the first mounting assembly to a substantially vertical wall; and securing the second mounting assembly to the substantially vertical wall.

For purposes of further disclosure, the following references generally related to erasable writing tablets and/or interconnected tablets and are hereby incorporated by reference in their entireties:

U.S. Patent Publication No. 2013/0164730 to Gustafson published on Jun. 27, 2013, and discloses improved rewritable surfaces and methods for making the same;

U.S. Patent Publication No. 2009/0266721 to Bala published on Oct. 29, 2009, which discloses a school organization system including a panel, an opening between a clear window and the panel for inserting a document thereto, a writing surface with a magnetic re-writable writing surface or a flexible magnetic dry erase board, a permanent calendar, and a folder;

U.S. Patent Publication No. 2013/0224723 to Gonzales et al. published on Aug. 29, 2013, which discloses an erasable marker board assembly with a metal backing panel, a pre-printed poster and a transparent panel;

U.S. Patent Publication No. 2013/0224722 to Petak published on Aug. 29, 2013, which discloses a system for attaching at least one writing tablet to a surface configured to receive the writing tablet with a surface allowing a user to draw or write on the surface in a dry or wet erase manner, including a backing element and a tablet element, each having a surface with an array of touch fastening elements allowing the backing element and tablet element to be removably engageable to one another;

U.S. Patent Publication No. 2011/0128216 to Renwick discloses a retractable hinge;

U.S. Patent Publication No. 2013/0157246 to Shapiro published on Jun. 20, 2013, and discloses a removable dry erase board;

U.S. Patent Publication No. 2006/0214919 to Moore et al. discloses a multi-panel writing surface and visual display device with each panel having an erasable surface, and which may be mounted to a surface to display information;

U.S. Patent Publication No. 2006/0257198 to Roeloffs;

U.S. Pat. No. 7,170,468 to Knopf discloses male and female docking members to interconnect two or more devices;

U.S. Patent Publication No. 2012/0171656 to Shen discloses a mobile handwriting recording instrument for use in a lecture or classroom setting that includes a writing tablet, which has a writing surface, a transmitter, a receiver, and a scanning device for capturing two or three dimensional indicia placed within the scanning device's field of view displaying an image representing the handwritten indicia remotely;

U.S. Patent Publication No. 2006/0236572 to Ko discloses an ornamental writing board having the ornamental function of a picture and comprising a board surface, a roll-up curtain, a frame surrounding the roll-up curtain, a pair of scrolls, and lights;

U.S. Pat. No. 6,266,045 to Myerson et al. discloses a housing with a handle assembly;

U.S. Pat. No. 4,911,536 to Ditzik discloses an interactive electro-optic display device used in combination with a transparent graphics tablet device providing an electronic writing surface for an integrated display-tablet operation;

U.S. Patent Publication No. 2012/0275842 to Nagao;

U.S. Patent Publication No. 2012/0268399 to Cheng et al. discloses a dynamic, dual-display system coupled with a computing device to provide at least two display panels for single-user or multiple-user applications;

U.S. Patent Publication No. 2012/0038570 to Delaporte discloses a reconfigurable touch screen computing device with folding configurations and an alignment locking mechanism;

U.S. Pat. No. 8,295,037 to Buuck et al. discloses an electronic device, such as an electronic book reader device, configured with two panels connected via a hinge;

U.S. Pat. No. 8,452,600 to Fleizach, which discloses an assisted electronic reader;

U.S. Pat. No. 7,604,481 issued to Owen et al. on Oct. 20, 2009; and

U.S. Pat. No. 7,354,273 issued to Donelan on Apr. 8, 2008.

Unless otherwise indicated, all numbers expressing quantities, dimensions, conditions, and so forth used in the specification and claims are to be understood as being modified in all instances by the term "about".

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone; B alone; C alone; A and B together; A and C together; B and C together; or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having," and variations thereof are meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
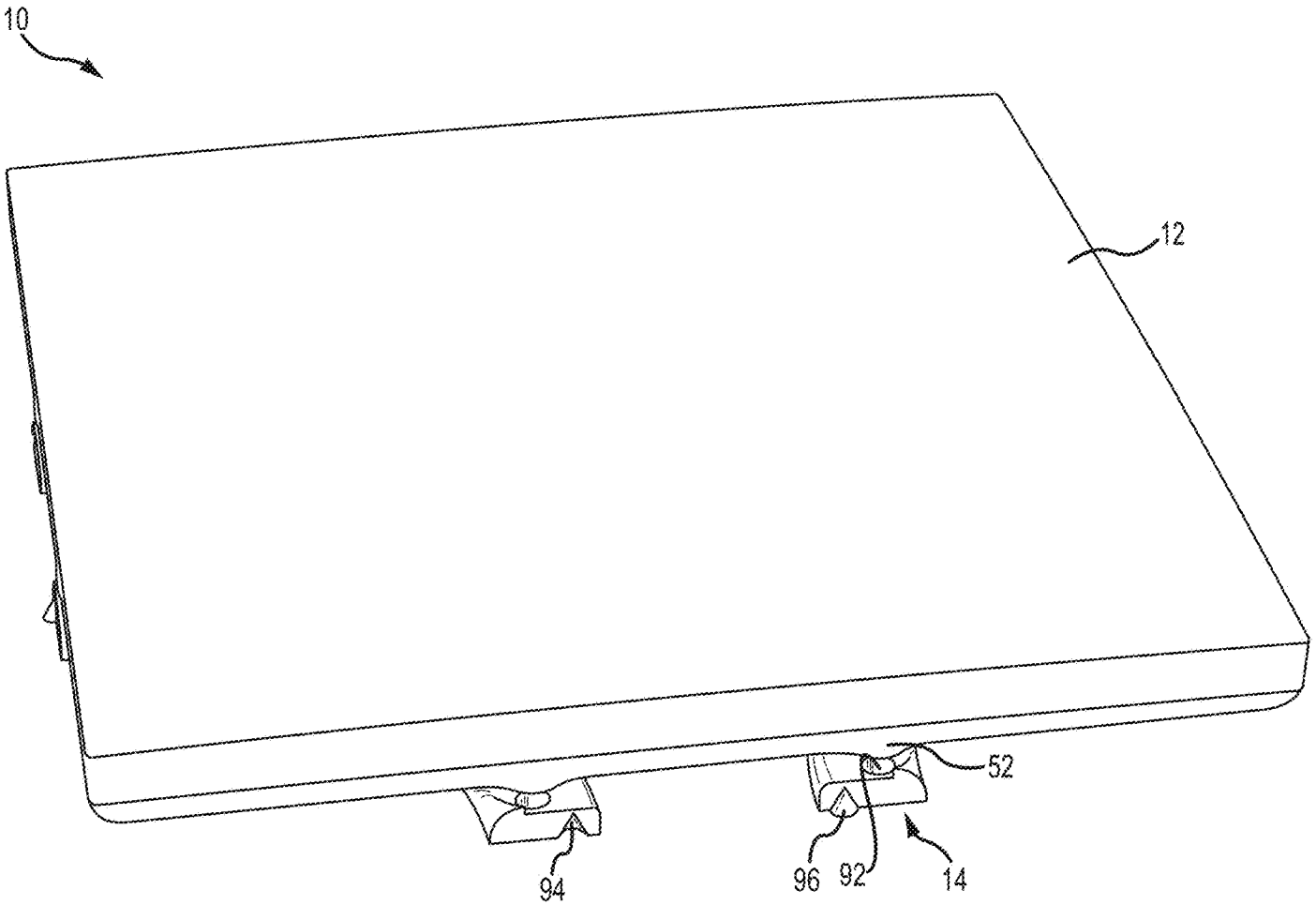
FIG. 1 is a top perspective view of one embodiment of a tablet assembly.

To assist in the understanding of the embodiments of the present invention the following list of components and associated numbering found in the drawings is provided herein:

| Component No. | Component Name |
|---|---|
| 10 | Tablet Assembly |
| 12 | Tablet |
| 12A-F | Tablets |
| 14 | Mounting Assembly |
| 14A-I | Mounting Assemblies |
| 20 | Tray |
| 22 | Insert |
| 24 | Frame |
| 26 | Magnet |
| 26A | Positively Oriented Magnet |
| 26B | Negatively Oriented Magnet |
| 42 | Protuberance (in Tray) |
| 50 | Lip (of Frame) |
| 52 | Magnet Holder |
| 54 | Aperture |
| 56 | Rib |
| 60 | Rear Surface (of Frame) |
| 62 | Extensions |
| 64 | Wall |
| 70 | Side (of Tray) |
| 72 | Side (of Frame) |
| 74 | Bottom Surface |
| 76 | Upper Surface (Crowned) |
| 78 | Lower Portion (of Side of Frame) |
| 90 | Mounting Bracket |
| 92 | Rivet |
| 94 | Indention |
| 96 | Protuberance |
| 100 | Lip (of Mounting Bracket) |
| 102 | Aperture |
| 104 | Vertical Line |
| 106 | Horizontal Line |
| 108 | Leg (of Mounting Bracket) |
| 110 | Rib |
| 130 | Plurality of Mounting Assemblies |
| 132 | Plurality of Tablet Assemblies |
| 150 | Eraser |
| 152 | Felt Top |
| 154 | Base (of Eraser) |
| 160 | Pen with Interconnection Mechanism |
| 162 | Cap (of Pen) |
| 164 | Base (of Pen) |
| 166 | Interconnection Mechanism |
| 170 | Pen with Interconnection Mechanism |
| 172 | Cap (of Pen) |
| 174 | Base (of Pen) |
| 176 | Interconnection Mechanism |
| W | Width of Interconnection Mechanism |
| L1 | Length of Frame |
| L2 | Length between Magnets (in Tablet) |
| L3 | Length of Mounting Bracket |
| L4 | Length of Mounting Bracket Legs |
| L5 | Length between Rivets (in Mounting Bracket) |
| R1 | First Radius |
| R2 | Second Radius |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

As described in detail below, various embodiments of the present invention include novel writing tablet designs and configurations comprising interconnection features and/or other features. The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed.

FIG. 1 is a perspective view of one embodiment of a tablet assembly 10. The tablet assembly 10 comprises a tablet 12 and a mounting assembly 14. Tablets 12 can be interconnected side-by-side on a horizontal surface (e.g., a table) or interconnected and mounted on a vertical surface (e.g., a wall), as shown in FIG. 13B. The mounting assembly 14 comprises one or more rivets 92, an indention 94 in the end of at least one leg, and a protuberance 96 extending from the end of at least one leg. The tablet 12 comprises one or more magnets contained within a portion of the tablet called magnet holders 52 herein. Note that the magnet holder 52 extends at least slightly from the side of the tablet 12. The magnets align with the one or more rivets 92 in the mounting assembly 14 to interconnect the tablet 12 to the mounting assembly 14. The indention 94 and protuberance 96 are described further in connection with FIGS. 9-10, 12-13A.

Figure 2:
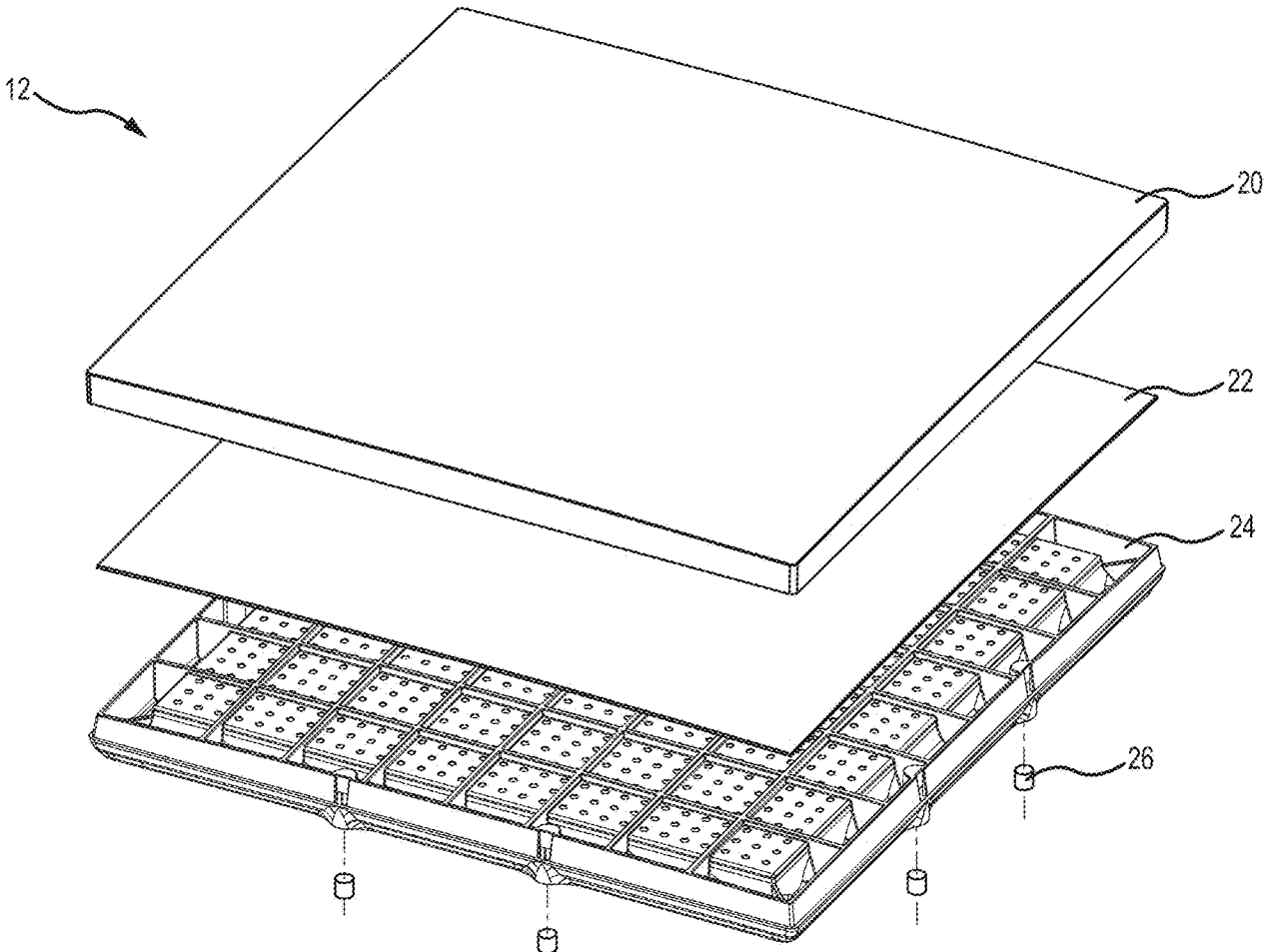
FIG. 2 is an exploded view of a tablet.

FIG. 2 is an exploded view of one embodiment of a tablet 12. The tablet 12 comprises a tray 20, an insert 22, and a frame 24. The tray 20 includes an upper surface that may be a smooth writing surface in some embodiments. The writing surface can be a dry-erase board on which dry-erase markers can be used to make erasable writings. However, the embodiments of the present invention are not limited to dry-erase types of surfaces, and may include other writing surfaces such as chalkboards. Further, the tray 20 can be clear such that the insert 22 can be seen through the tray 20. In one embodiment, the tray 20 includes a slightly crowned center portion, which reduces or eliminates warping during manufacturing and makes the tablet 12 stronger when a user is writing on the tray 20. Additionally, a tray 20 with a slightly crowned center portion provides a nice writing surface for the user. The frame 24 includes one or more magnets 26. The magnets 26 can be n42 magnets, or any other rare earth magnets known in the art. In one embodiment, the frame 24 includes two magnets 26 on each of the four sides of the frame 24. In an alternate embodiment, the tray or frame can have a slot to insert a drawing or image.

In one embodiment, the insert 22 is a thin film and the tablet is digital. Thus, the thin film can be a film similar to the films used in screens of electronic tablets such as Kindles, iPads, etc. The film will enable the tablet 12 to have a low powered display. Accordingly, the tablet 12 can still have a smooth, upper surface for writing and have the thin film behind the tray 24 and writing surface. Therefore, images could be displayed on the tablet 12 and users could write on top of the images. Further, the film enables the tablet 12 to act as a portable black and white electronic reader. Adding electronic components to the tablets 12 enable the system to be used as modular signage. For example, a map could be displayed on the tablets 12, and then the map could change to lines, graphs, directions, etc. at the touch of a button. Further, adding electronic components to the tablets 12 and system can create a smart board if the tablets 12 know where they are positioned within the system. For example, a first tablet 12 would know it was positioned on an upper right corner and a second tablet would know it was positioned on a lower left corner. The tablets 12 must further know if and to where they are moved within the system. Additionally, if electronics are added to the tablets 12, then the tablets 12 will need displays (such as display screens to display digital content), power sources (which can be batteries, for example), processors, memory (which can include data storage), software, electrical circuits, etc. to operate the tablets 12 and system.

Figure 3:
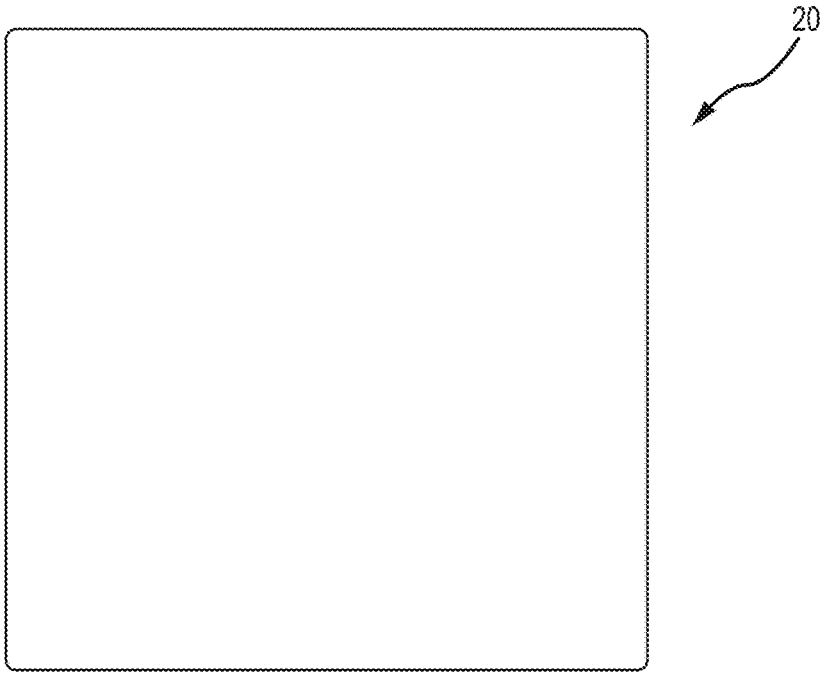
FIG. 3 is a top plan view of a tray.
Figure 4:
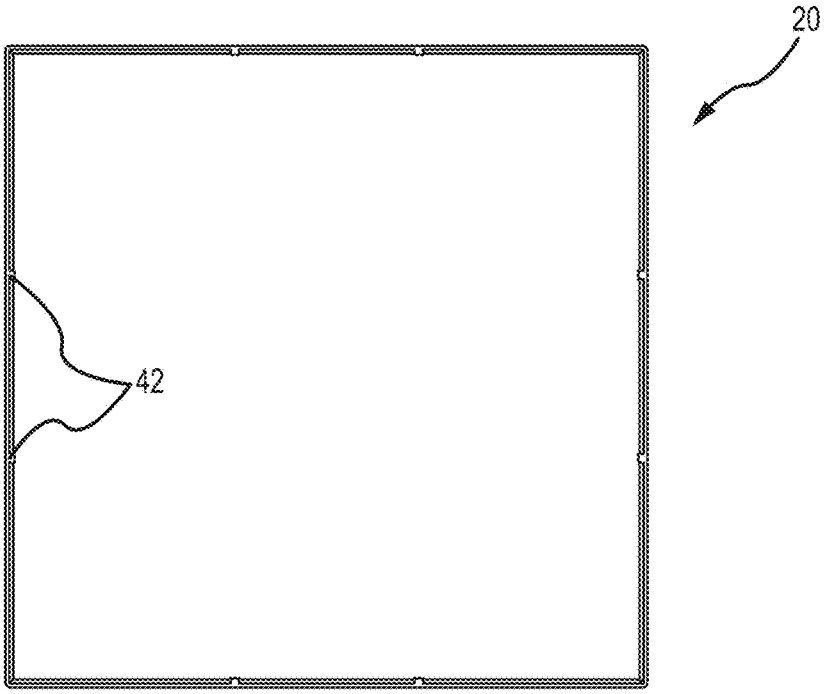
FIG. 4 is a rear view of the tray.

FIG. 3 is a top plan view of the tray 20 showing the upper surface of the tray 20. In the embodiment shown, the upper surface of the tray 20 is smooth such that a user can write on the upper surface. FIG. 4 is rear view of the tray 20 showing the underside of the tray 20, which includes protuberances 42 and a geometry that conforms to the upper side of the frame 24. Various embodiments of the present invention include trays 20 composed of various materials, for example, glass, acrylic, abrasion resistant acrylic, PETE, polycarbonate, polyethylene, thermoplastic, other polymers, porcelain, plastic, cork, or grapheme. Thus, if at least a portion of the tray 20 is composed of cork or a cork-like material, then the tablet 12 could be used like a moveable cork board where a user can hang paper and other items on the tablet 12 using tacks, pins, nails, etc. Additionally, the tray 20 may have a coating or an additional layer (e.g., a membrane) to keep the tray 20 clean and free of scratches. A coating on the clear writing surface may be needed to prevent the writing surface from becoming scratched, which would hinder the visibility of the insert 22 behind the tray 20. The coating or additional layer may also minimize ghosting, provide a better writing surface, reduce surface glare, and/or prevent the tray from cracking or shattering. The tray 20 may include a top coat to prevent the writing surface from scratching. Further, the top coat may improve the writing and erasing characteristics of the writing surface. In some embodiments the tablet may be a touch screen. In these embodiments, the coating or additional layer will not prevent the capacitance sensing screen from receiving inputs from the user.

Figure 5:
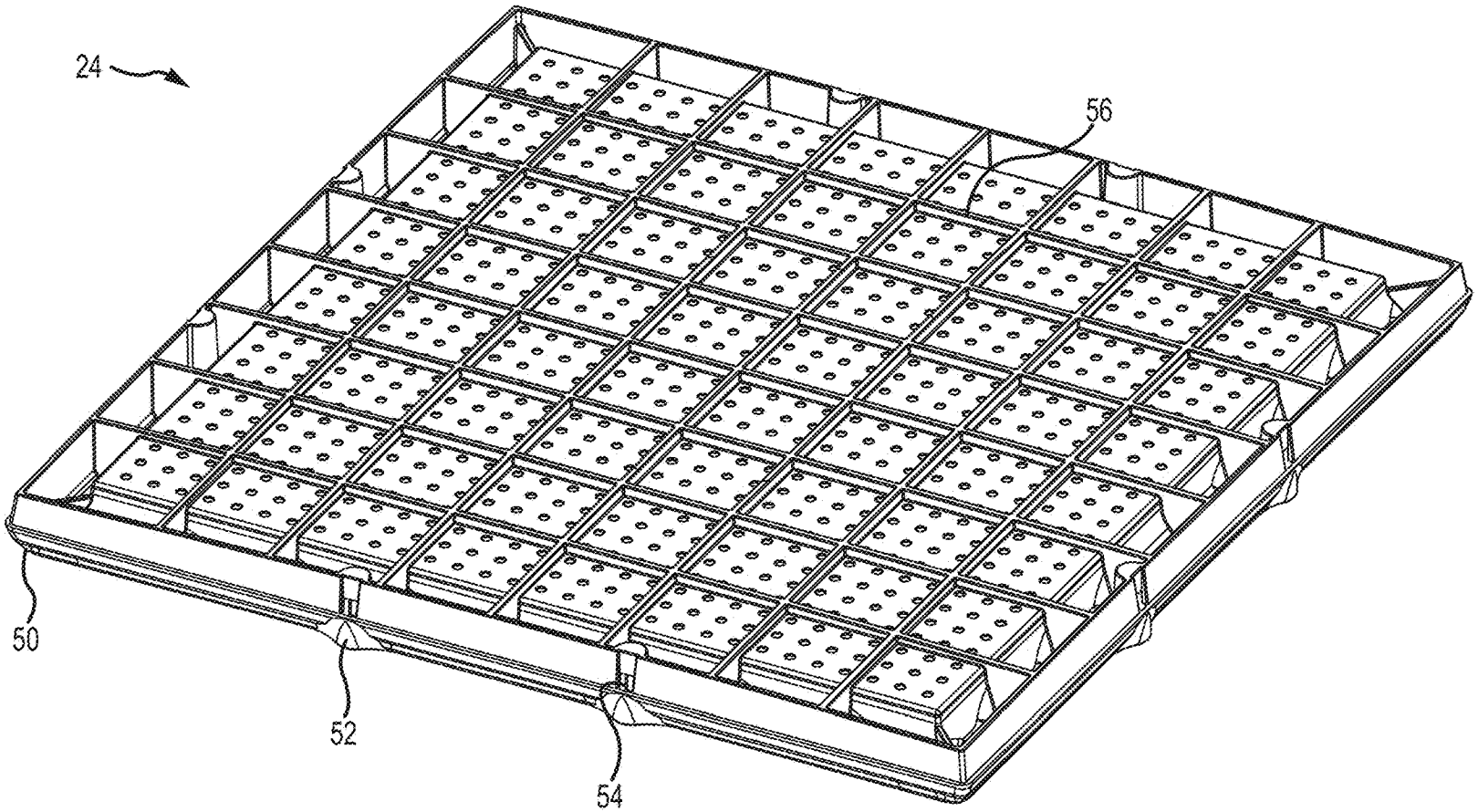
FIG. 5 is a perspective view of a frame.

FIG. 5 is perspective view of the upper side of the frame 24 of the tablet 12. The sides of the frame 24 comprise magnet holders 52, an aperture 54, and a lip 50 for interconnecting with the edges of the underside of the tray 20. The lip 50 creates an indention around the frame 24 into which the tray 20 can snap to secure the tray 20 to the frame 24. Thus, a portion of the tray 20 sits within the lip 50 of the frame 24 to interconnect the tray 20 to the frame 24. The frame 24 also includes ribs 56 upon which the insert 22 and/or tray 20 rests. The ribs 56 may be taller in a center portion of the frame 24 such that crowned center portion of the tray 20 conforms to the raised center ribs 56 of the frame 24. In one embodiment, the ribs 56 proximate to a center of the frame 24 are about 4 mm tall (above the horizontal surface of the frame) and the ribs proximate to the edges or sides of the frame 24 are about 1 mm tall.

The aperture 54 of the frame 24 receives the protuberance 42 of the tray 20 to form a snap-fit interconnection between the tray 20 and the frame 24. The interconnection between the aperture 54 and the protuberance 42 can more clearly be seen in FIG. 8. In some embodiments, the aperture 54 is aligned with the magnets 26 to reduce the manufacturing costs of an injection molded frame. The manufacturing costs are reduced because an action is not needed to get the frame 24 out of the mold. Rather, the aperture 54 is used to get the frame 24 out of the mold; thus, the aperture 54 is a straight-pull feature. In various embodiments, the aperture 54 has various shapes and sizes.

The frame 24 can be manufactured of any material known in the art, such as plastic, metal, or composite material. In one embodiment, the frame 24 is composed of thermoplastic material, which can be any thermoplastic such as acrylonitrile butadiene styrene (ABS). The frame 24 may be clear, opaque, or colored. In one embodiment, the frame member is black ABS. In another embodiment, the frame member is clear polycarbonate.

Figure 6:
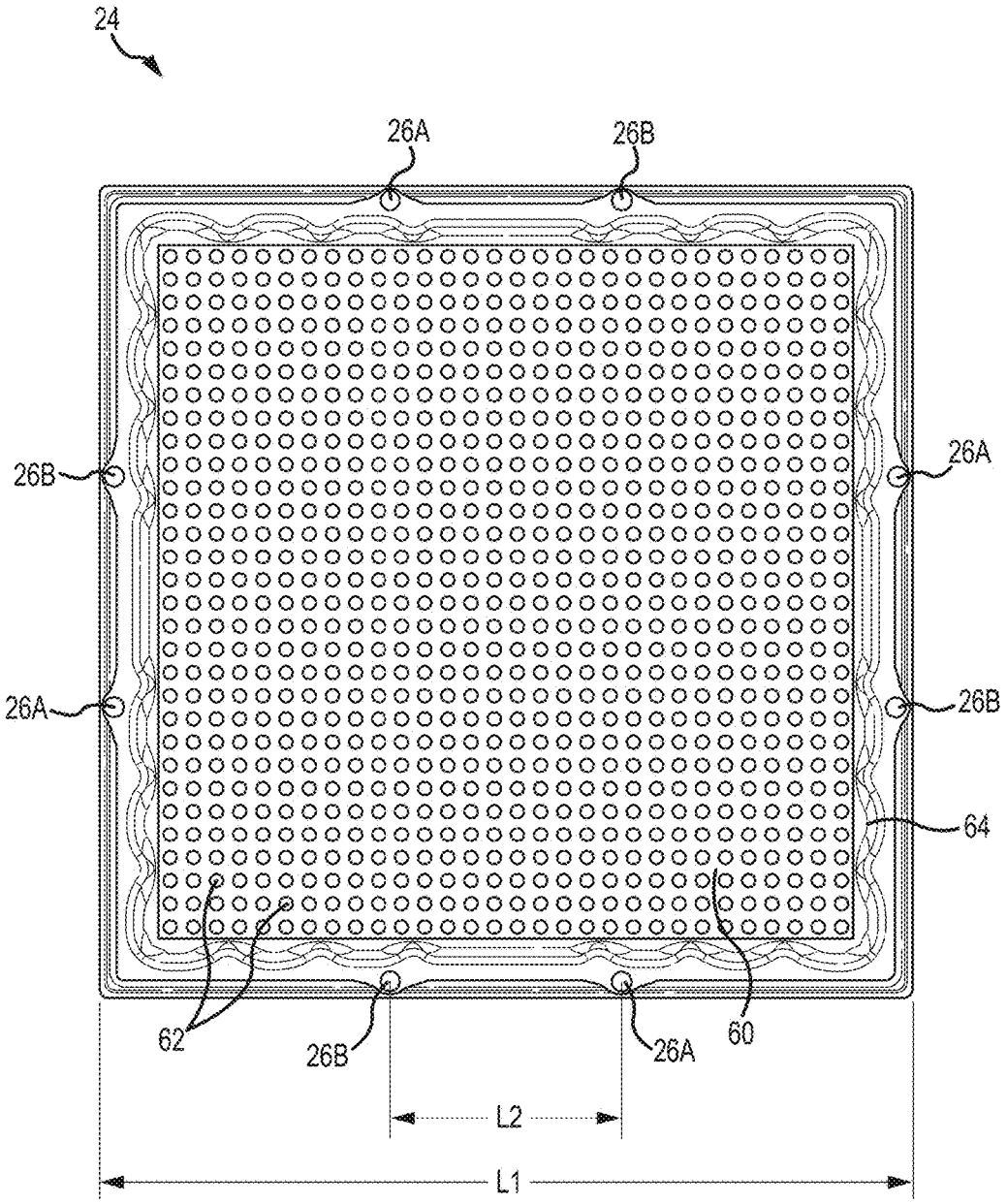
FIG. 6 is a rear view of the frame.

FIG. 6 is a rear view of the frame 24. The rear surface 60 of the frame 24 is designed to hold or interconnect to various items for storage of the various items. In one embodiment, the rear surface 60 comprises a brick connection with extensions 62 and channels between the extensions 62 to interconnect with accessories. In one embodiment, the rear surface 60 comprises clips, snaps, hooks, or other interconnection mechanisms to secure accessories, paper, an iPad, or an electronic tablet to the rear surface 60 of the tablet frame 24. The frame 24 also includes a wall 64 surrounding the rear surface 60. The wall 64 creates a region within the wall 64 where accessories and other items can be stored within the tablet 12. Thus, the height of the wall 64 is sized to keep small accessories contained within the tablet 12 when the tablet 12 is positioned on a substantially flat surface. Further, when two tablets 12 are interconnected back-to-back, the bottom surface 74 of the first tablet's wall 64 is positioned substantially flat against the bottom surface 74 of the second tablet's wall 64, creating area between the tablets 12 for containing accessories or items. Accordingly, the wall height can be sized to keep larger accessories (e.g., books, electronic tablets, and iPads) contained within the two tablets 12.

The wall 64 has one or more magnets 26 in each side. In the embodiment shown, the wall 64 has two magnets 26A, 26B on each side, where one magnet is a positively oriented magnet 26A and one magnet is a negatively oriented magnet 26B. The magnets 26 alternate positively oriented magnet 26A and negatively oriented magnet 26B around the wall 64 such that the magnets 26 will attract magnets 26 of the opposite polarity on other tablets 12 if two tablets 12 are interconnected back-to-back or side-by-side. Using magnets 26 to interconnect two or more tablets 12 allows the tablets 12 to align properly and easily. Additionally, the tablets 12 are easy to disconnect. The embodiment shown in FIG. 6 does not have magnets 26 in the corners of frame 24 so that the tablet 12 can easily be detached from the mounting assembly 14 when the mounting assembly 14 is interconnected to a vertical wall. Specifically, a user can push on a corner of the tablet 12 to detach the tablet 12 from the mounting assembly 14 without detaching other tablets 12 if the tablet 12 is in a system of tablets secured to a vertical wall. Further, as can be seen in the figures, the magnets 26 in the frame 24 align with rivets or pins 92 in the mounting assembly 14 to secure the tablet 12 to the mounting assembly 14.

The magnets 26A, 26B can be inserted into the frame 24 from the underside of the frame 24 in one embodiment. The magnets 26A, 26B can be glued into the frame 24 or held in the frame 24 through a mechanical fit, such as a tension-fit, snap-fit, or friction-fit. In other embodiments, the magnets 26A, 26B are secured within the frame in any manner known in the art such that the magnets 26A, 26B are positioned proximate to the perimeter of the frame 24 and positioned proximate to the underside of the frame. The position of the magnets 26A, 26B enables two or more tablets 12 to interconnect to one another back-to-back and side-by-side.

The wall 64 has curves on an inner side of the wall, the side proximate to the rear surface 60 of the frame 24. The curves assist a user in gripping the tablet 12 and frame 24. Thus, the curves of the wall 64 may be sized and shaped to fit a user's fingers.

Figure 7:
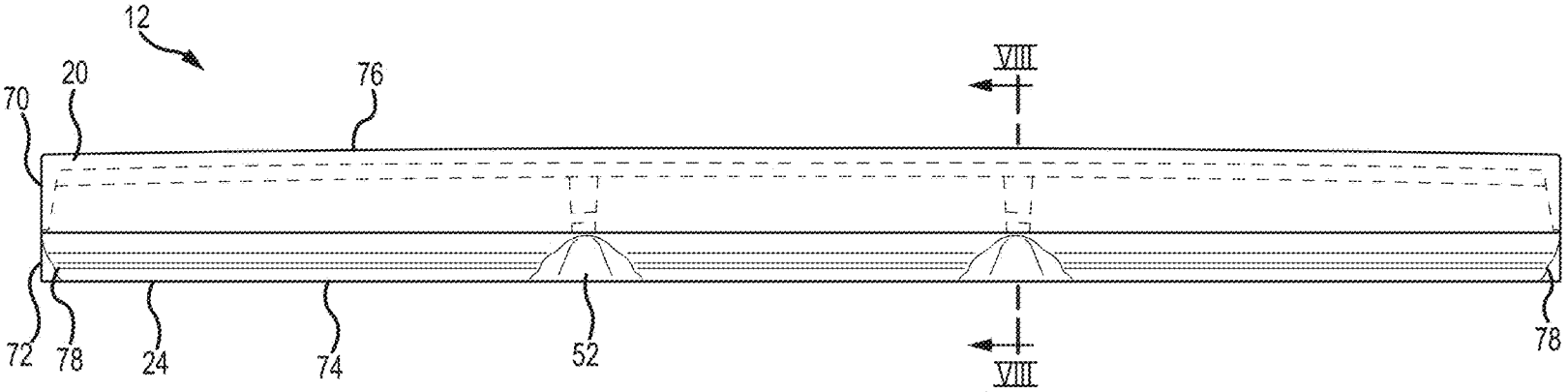
FIG. 7 is a side elevation view of the tablet.

The lower portion 78 of the side of the frame 24 curves inward and the magnet holders 52 protrude at least partially from the side of the frame 24, as can be seen in FIGS. 5-7. The magnet holders 52 extend from the sides of the frame 24 because the magnets 26 need to be as close to the edge of the frame 24 as possible to enable the magnets 26 of different tablets 12 to interact and interconnect with one another. Further, magnet holders 52 that extend at least partially from the sides of the frame 24 enable the magnets 26 of different tablets 12 to be positioned closer to one another to form stronger interconnections. Additionally, the curve of the magnet holder 52 works with the lip 100 of the mounting bracket 90 to secure the tablet 12 to the mounting assembly 14 on an at least partially vertical wall.

The length L1 of the frame 24 is between 200 mm and 400 mm in one embodiment. The length L1 of the frame 24 is between 250 mm and 350 mm in a preferred embodiment. The length L1 of the frame 24 is between 275 mm and 300 mm in a more preferred embodiment. The length L1 of the frame 24 is about 280.0 mm in a most preferred embodiment. The length L2 between two magnets 26 is between 50 mm and 100 mm in one embodiment. The length L2 between two magnets 26 is between 75 mm and 85 mm in a preferred embodiment. The length L2 between two magnets 26 is about 80.0 mm in a more preferred embodiment.

FIG. 7 is a side elevation view of the tablet 12. The tablet 12 comprises a tray 20 and a frame 24. The tray 20 has an upper surface 76 and a side 70. The upper surface 76 is the writing surface in some embodiments. Further, the upper surface 76 is slightly crowned, where the center portion has a height that is higher than the side 70. The frame 24 has a bottom surface 74 and a side 72, which includes a lower portion 78. The side 72 of the frame 24 generally curves inward, as is shown by the profile of the lower portion 78. Additionally, the side 72 includes at least one magnet holder 52 that protrudes or extends from the side 72, which is also shown in the profile on either side of FIG. 7.

Figure 8:
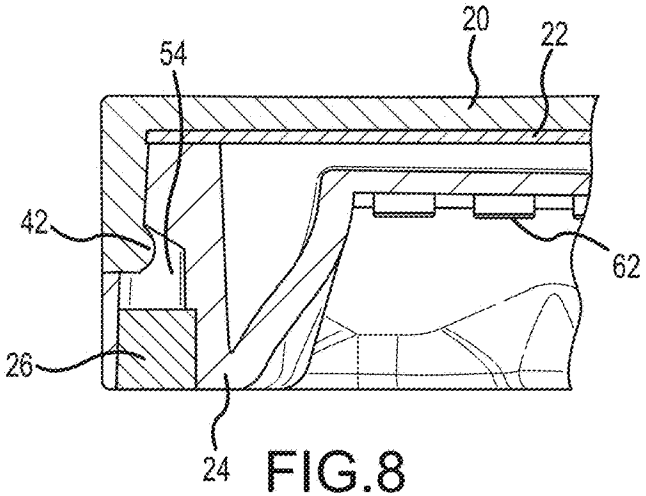
FIG. 8 is a cross-sectional view of the tablet at cut VIII-VIII.

FIG. 8 is a cross-sectional view of a section of the tablet 12 along cut VIII-VIII. The tray 20 with a protuberance 42 is interconnected to the frame 24 via a snap-fit of the protuberance 42 in the aperture 54 of the frame 24. The magnet 26 is positioned below the aperture 54 and protuberance 42. An insert 22 is positioned between the frame 24 and the tray 20. The extensions 62 of the brick connection of the rear surface of the frame 24 can also be seen in FIG. 8.

Figure 9:
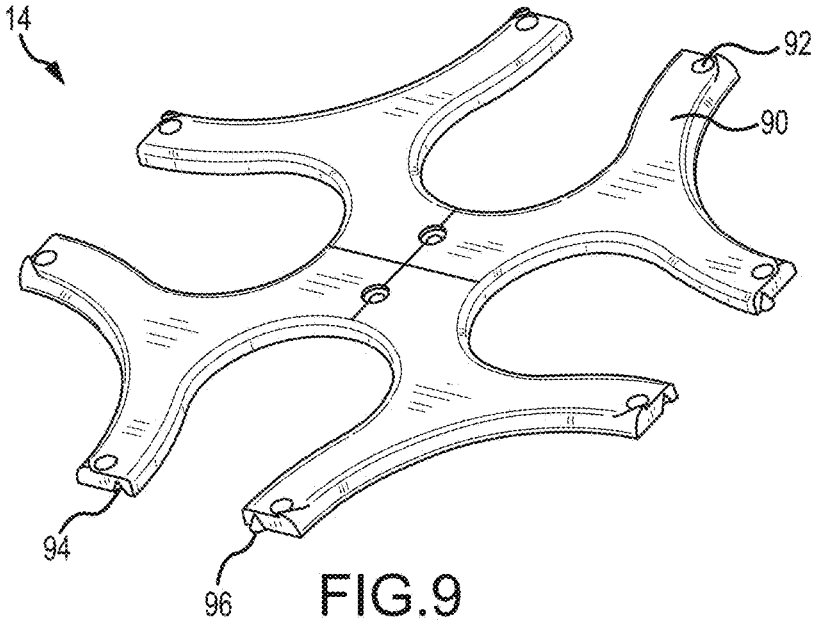
FIG. 9 is a perspective view of a mounting assembly.
Figure 10:
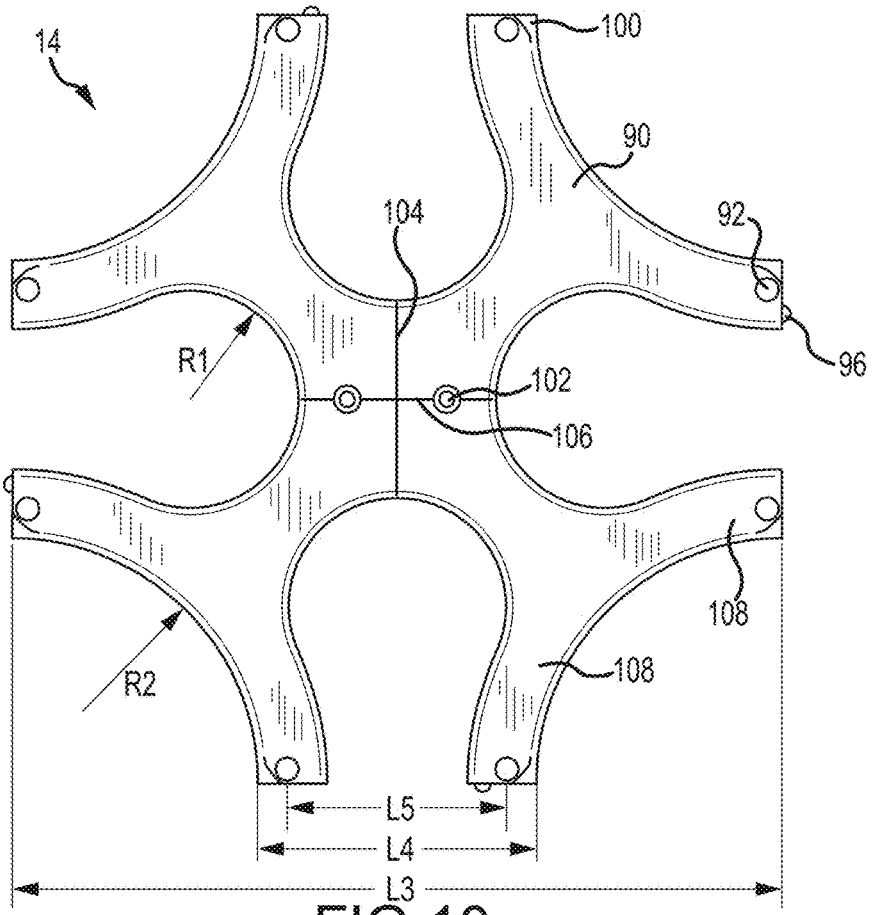
FIG. 10 is a top plan view of the mounting assembly.

FIGS. 9 and 10 show a mounting assembly 14 according to one embodiment. The mounting assembly 14 comprises a mounting bracket 90, at least one rivet 92, an aperture 102, a vertical line 104, a horizontal line 106, and legs 108. Each leg 108 comprises either a protuberance 96 or an indention 94. The protuberance 96 is sized to fit within an indention 94 of another mounting assembly 14. The protuberances 96 and indentions 94 assist in aligning the mounting assemblies 14. Further, the protuberances 96 and indentions 94 keep the mounting assemblies 14 aligned and interconnected to one another. Additionally, a user can interconnect the mounting assembly 14 to a wall or other surface by inserting a securing mechanism (e.g., nails, pins, rivets, or screws) through the one or more apertures 102. The embodiment shown in FIGS. 9 and 10 has two apertures 102; however, one aperture 102 can be used or three or more apertures 102 can be used in alternate embodiments. The horizontal line 106 and vertical line 104 assist a user in mounting the mounting assembly 14 in a straight and level position.

Each rivet 92 is positioned at the end of a leg 108 and is positioned to align with a magnet 26 of the tablet 12. The mounting bracket 90 comprises a first radius R1 and a second radius R2. The second radius R2 is chosen such that when four mounting assemblies 14 are interconnected to one another, the second radius R2 forms a circle (see FIGS. 13A-B). The first radius R1 is chosen to create legs 108 with the desired width or thickness and to create legs 108 with rivets 92 positioned at the desired width L5. The curves of the mounting bracket 90 created by the radii R1, R2 assist the user in detaching the tablet 12 from the mounting assembly 14 because the mounting bracket 90 does not have material proximate to the corner of the tablet 12. In one embodiment, the void of material in the corner of the mounting bracket 90 is required to allow the tablet 12 to disconnect from the mounting assembly 14 by pushing on a corner of the tablet 12. Thus, the curves of the mounting bracket 90 and the positioning of the rivets 92 work together to create a tablet 12 that can be easily removed from a vertically mounted mounting assembly 14, but the tablet 12 also stays interconnected to the mounting assembly 14. Furthermore, the rounded edges of the mounting bracket 90 assist a user in detaching the tablet 12 from the mounting assembly 14 because when a user pushes on a corner of the tablet 12, the tablet 12 is able to pivot or rotate along the curved edge of the mounting bracket 90.

The mounting assembly 14 further includes a lip 100 on an end of at least one leg 108 to prevent the tablet 12 from sliding off of the mounting assembly 14 when the mounting assembly 14 is positioned in a substantially vertical position and a user pushes on a corner of the tablet 12 to release the tablet 12 from the mounting assembly 14. Without the lip 100, the tablet 12 would likely slide off of the mounting assembly 14 when the user pushed on a corner of the tablet 12, which would likely cause the tablet 12 to slide into other tablets 12 and possibly knock the other tablets off of the wall or mounting assemblies 14. In one embodiment, each leg 108 has a lip 100 at the end of the leg 108. Further, the lip 100 can be curved-shaped and positioned in a corner of the leg 108 closest to a corner of the tablet 12. The curve of the lip 100 matches the bow or curve of the magnet holder 52 in the frame 24 so that the lip 100 does not hinder the positioning and interconnection of the frame 24. In one embodiment, the lip 100 has a height of between 0.75 mm and 1.75 mm above the upper surface of the mounting bracket 90. In another embodiment, the lip 100 has a height of between about 1.0 mm and 1.5 mm above the upper surface of the mounting bracket 90.

The mounting bracket 90 can be manufactured of any material known in the art, for example, plastic, metal, or composite material. In one embodiment, the mounting bracket 90 is composed of thermoplastic material, which can be any thermoplastic such as acrylonitrile butadiene styrene. The rivet 92 can be a pin, nail, or other ferrous metal item secured within or on the mounting bracket 90 to interconnect to the magnet 26 of the tablet 12. The rivet 92 can be a tension-fixed rivet 92 or it can be glued or adhered to the mounting bracket 90.

FIG. 10 also shows various measurements of the mounting assembly 14. In one embodiment, the mounting bracket 90 is square-shaped, similar to the square-shaped tablet. The length L3 of the mounting bracket 90 is between 200 mm and 400 mm in one embodiment. The length L3 of the mounting bracket 90 is between 250 mm and 350 mm in a preferred embodiment. The length L3 of the mounting bracket 90 is between 275 mm and 300 mm in a more preferred embodiment. The length L3 of the mounting bracket 90 is about 280.40 mm in a most preferred embodiment. The length L4 of the mounting bracket legs 108 is between 75 mm and 125 mm in one embodiment. The length L4 of the mounting bracket legs 108 is between 95 mm and 105 mm in a preferred embodiment. The length L4 of the mounting bracket legs 108 is about 102 mm in a more preferred embodiment. The length L5 between two rivets 92 is between 50 mm and 100 mm in one embodiment. The length L5 between two rivets 92 is between 75 mm and 85 mm in a preferred embodiment. The length L5 between two rivets 92 is about 80.0 mm in a more preferred embodiment. The length L5 between two rivets 92 is important because if the length L5 is too large, then the tablet 12 is difficult to remove from the mounting assembly 14. Additionally, if the length L5 is too small, then the tablet 12 detaches from the mounting assembly 14 too easily and may even fall off of the mounting assembly 14 when positioned in a substantially vertical position. Thus, the distance from the edge of the mounting bracket leg 108 to the corner of the frame 24 is between 75 mm and 125 mm in one embodiment. The distance from the edge of the mounting bracket leg 108 to the corner of the frame 24 is between 85 mm and 95 mm in a preferred embodiment. The distance from the edge of the mounting bracket leg 108 to the corner of the frame 24 is about 89 mm in a more preferred embodiment.

The combination of the height of the lip 100 of the mounting bracket 90, the magnet/rivet distances L2, L5, and the strength of the magnets 26 prevent the tablet 12 from falling off of a mounting assembly 14 positioned on a vertical surface, while allowing a user to easily remove the tablet 12 from the vertically mounted mounting assembly 14.

Figure 11:
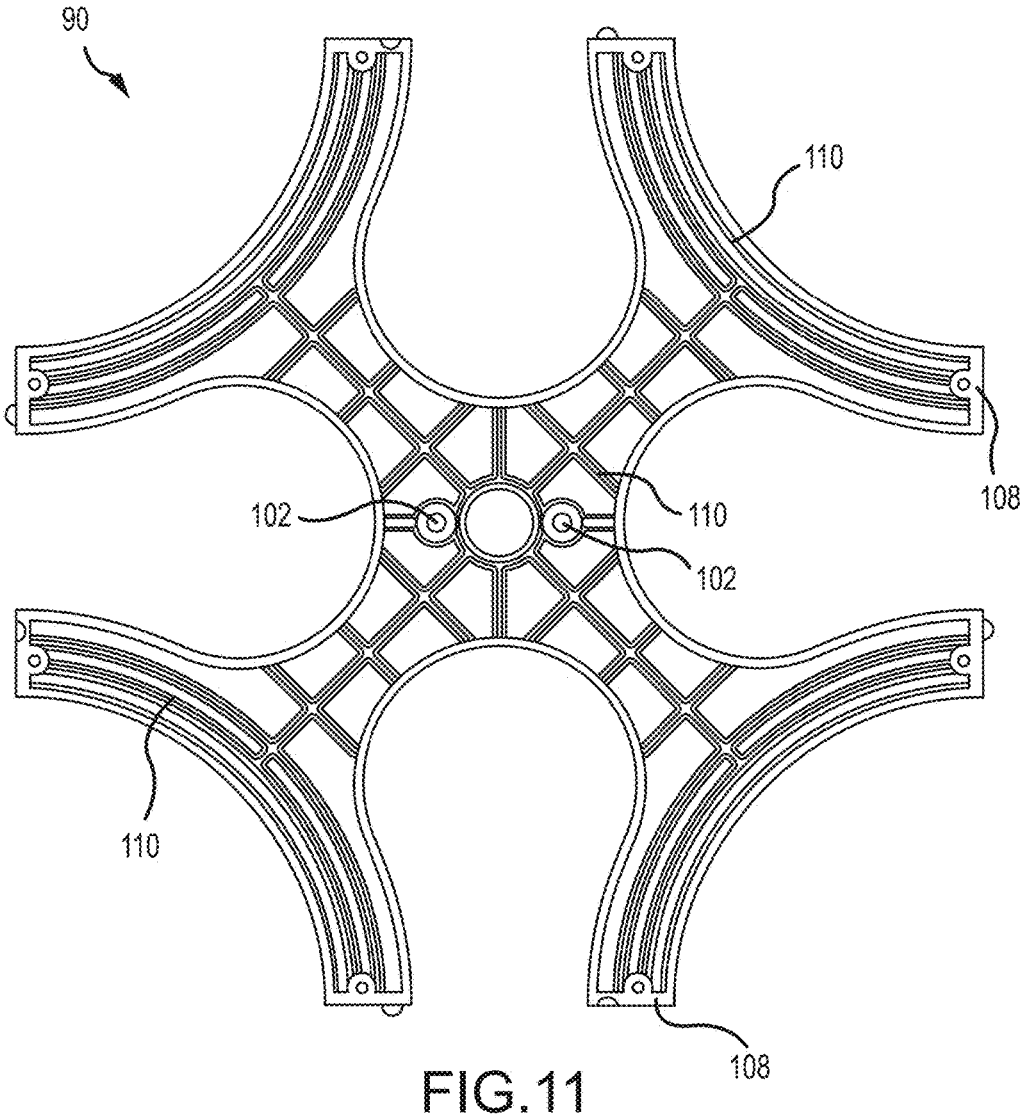
FIG. 11 is a rear view of a mounting bracket.

FIG. 11 is a rear view of the mounting bracket 90. In one embodiment, the mounting bracket 90 comprises one or more ribs 110. The ribs 110 are raised relative to the back surface of the mounting bracket 90. In some embodiments, the ribs 110 proximate to a center portion of the mounting bracket 90 are shorter than the ribs 110 proximate to the ends of the legs 108 of the mounting bracket 90 such that there is a space between the ribs 110 proximate to a center portion of the mounting bracket 90 and the flat surface of a wall or table, whereas there is not a space between the ribs 110 proximate to the ends of the legs 108 of the mounting bracket 90 and the flat surface of a wall or table. Thus, this configuration (i.e., the difference in height of the various ribs) creates a mounting bracket 90 with an upper surface that is substantially flat and a bottom surface (i.e., the bottom surface of the ribs) that is slightly crowned proximate to a center portion of the mounting bracket 90. Thus, when the mounting assembly 14 is interconnected to a wall via screws or other securing mechanisms positioned through the apertures 102 located proximate to the center portion of the mounting bracket 90, the legs 108 push against the wall or substantially flat surface. Accordingly, there is not a gap between the bottom surface of the legs 108 of the mounting bracket 90 and the wall or flat surface. Specifically, there is not a space between the ends of the legs 108 and the wall such that a majority of the mounting bracket 90 is flat against the wall.

Figure 12:
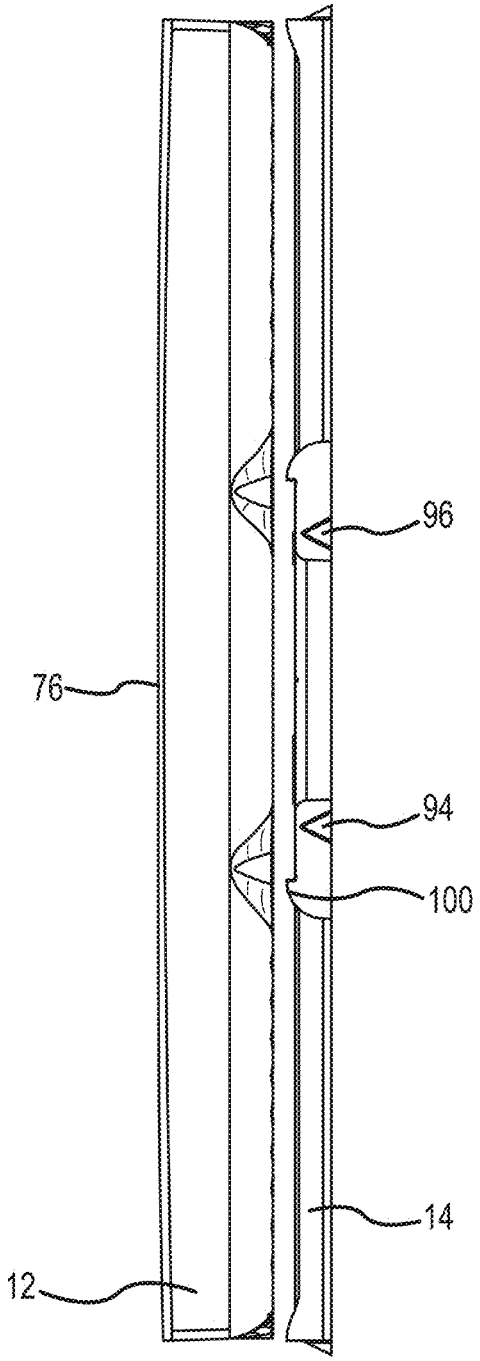
FIG. 12 is a side elevation view of the tablet assembly.

FIG. 12 is a side elevation view of the tablet assembly 10, which comprises a tablet 12 and a mounting assembly 14. The upper surface 76 of the tablet 12 is slightly crowned (i.e., taller or higher in a center portion) and is positioned opposite the mounting assembly 14. The mounting assembly 14 has a protuberance 96 extending outwardly from one leg 108 of the mounting bracket 90, an indention 94 in a second leg 108 of the mounting bracket 90, and a lip 100 extending upwardly from an upper surface of the mounting bracket 90. In one embodiment, each leg 108 has a lip 100 positioned proximate to an end of the leg 108. It can be seen that the legs 108 of the mounting bracket 90 align with the magnet holders 52 of the tablet frame 24.

Figure 13A:
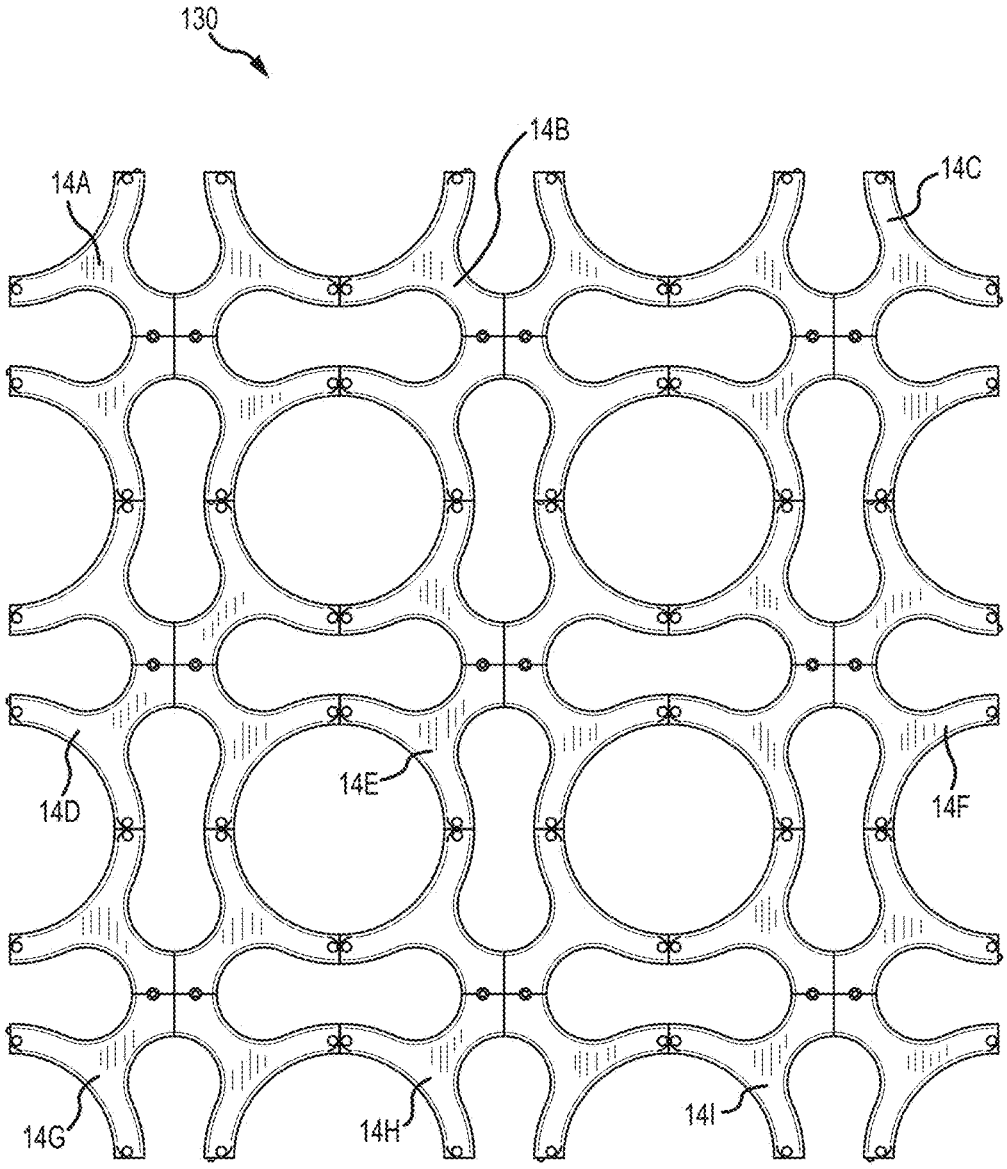
FIG. 13A is a top plan view of a plurality of mounting assemblies.
Figure 13B:
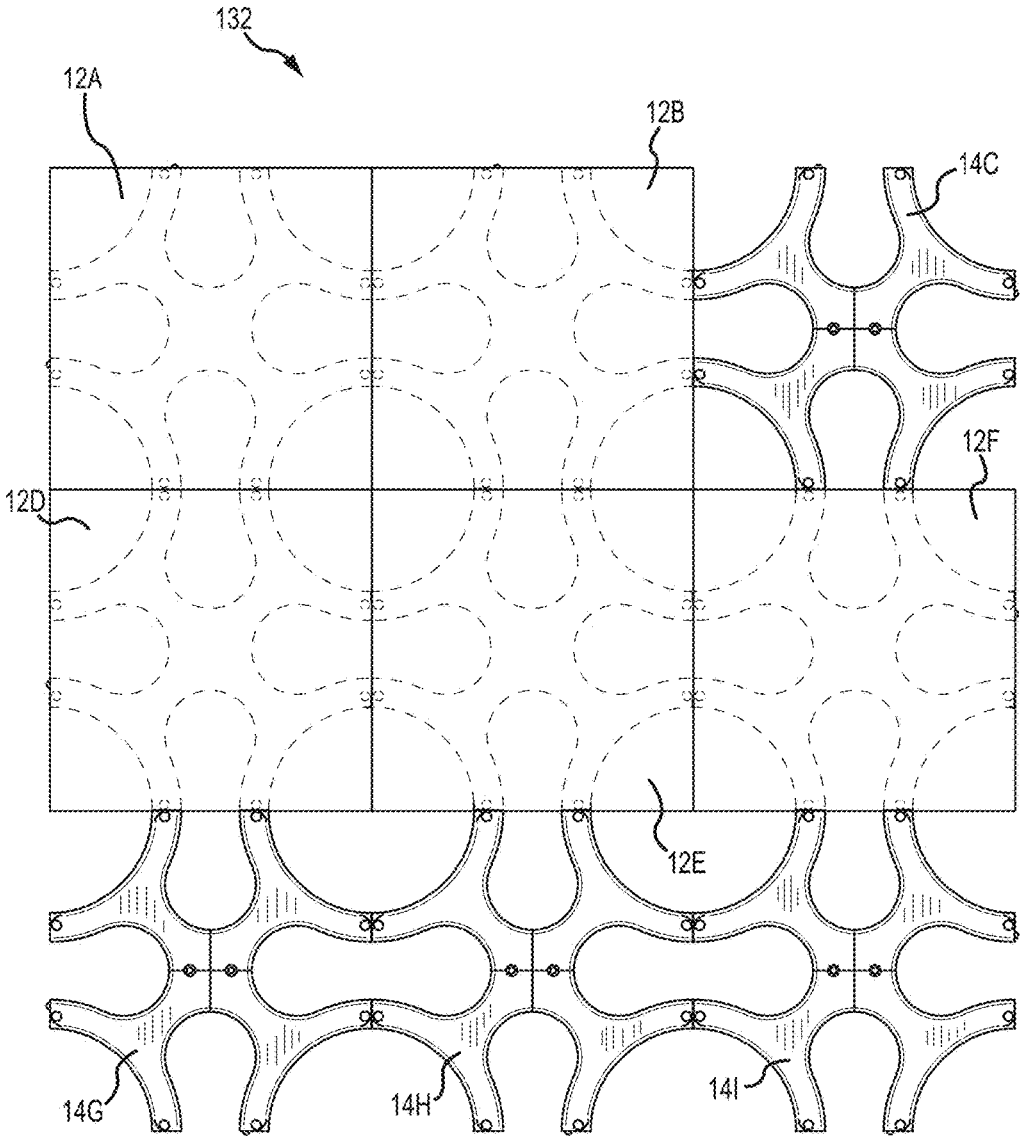
FIG. 13B is a top plan view of a plurality of tablet assemblies.

FIG. 13A shows a plurality of mounting assemblies 130. Nine mounting assemblies 14A-I are shown in the plurality of mounting assemblies 130. The protuberances 96 and indentions 94 of the mounting brackets 90 work to align the mounting assemblies 14A-I in the correct position.

FIG. 13B is shows a plurality of tablet assemblies 132. In the embodiment shown, five tablets 12A, 12B, 12D, 12E, 12F are interconnected to mounting assemblies (shown in phantom underneath the tablets). The plurality of tablet assemblies 132 is shown with additional mounting assemblies 14C, 14G, 14H, 14I. Accordingly, the tablets 12A, 12B, 12D, 12E, 12F can be moved around and positioned on different mounting assemblies.

The multiple mounting assemblies 14A-I and tablets 12A-F are interconnected to one another. In the embodiment shown, multiple tablets 12A-F can be interconnected to one another, arranged, and rearranged depending on the user's needs. Accordingly, if one tablet 12 contains information that would make more sense positioned in a different location relative to the other tablets 12, then the one tablet 12 can easily be disconnected, moved, and re-interconnected to a different mounting assembly 14 and the other tablets 12.

The tablets 12A-F are easily detachable from the mounting assemblies 14A-I by pushing on a corner of the tablet 12 because the mounting assemblies 14A-I do not extend to the corners of the tablets 12A-F. Specifically, a user can push on a corner of the tablet 12 to detach the tablet 12 from the mounting assembly 14 without detaching other tablets 12A-F if the tablet 12 is in a system of tablets 12A-F secured to a vertical wall because only the one tablet 12 upon which the user pushed will detach from its mounting assembly 14.

In an alternate embodiment, to allow the tablet 12 to be easily removed from a wall, especially a middle or center tablet in a system of multiple tablets 12, the corners of the tablet 12 may be shorter (i.e., shorter in height) than the sides of the tablet 12. Thus, a portion of the bottom surface 74 of the sides of the tablet 12 may be angled such that the side is the shortest at an edge or end, i.e., a corner. The angled bottom edge allows a user to push on one corner of the tablet 12 and pop the opposite corner of the tablet 12 off of the wall, table, or other surface. Angling the bottom edge of the tablet 12 allows the tablet 12 to rock when a user pushes on one corner of the tablet 12 such that the opposite corner lifts up in an amount equal to the amount that the one corner is pushed downward, if the pivot point is positioned in the exact center of the tablet 12. However, in one embodiment the tablet pivot point is off center, creating a lever by which the corner upon which the user pushes downward travels a shorter distance than the distance the opposite corner lifts upward. In an alternate embodiment, the tablet 12 may be flexible and able to be bent to pull the tablet 12 away from the wall or mounting bracket 14. Alternatively, only the writing surface of the tablet 12 may pop out and the tablet base may stay secured to the wall.

Figure 14:
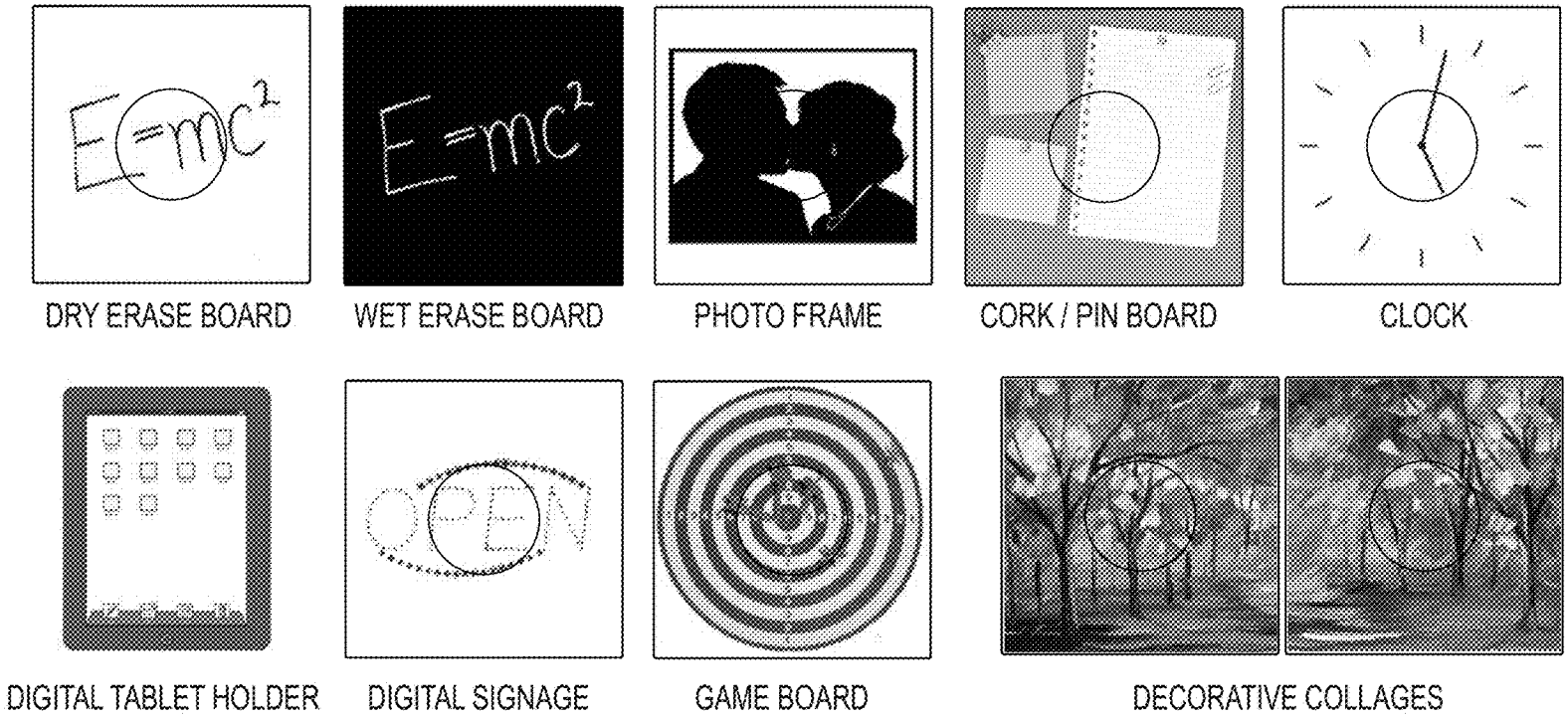
FIG. 14 shows various uses of the tablet assemblies.

FIG. 14 shows various surface examples that can be used in various embodiments. For example, the tablet can be a dry erase board, a wet erase board, a photo frame, a cork or pin board, a clock, a digital tablet holder, a digital sign, a game board, a decorative collage, artwork, or any other item designed to hang on a substantially vertical wall.

Figure 15A:
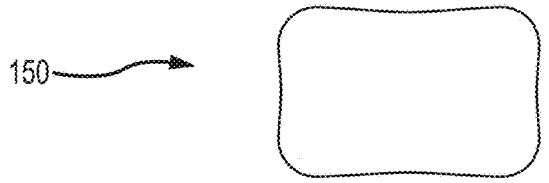
FIG. 15A is a top plan view of an eraser.
Figure 15B:
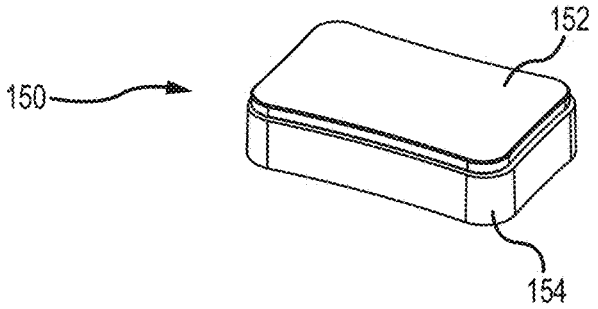
FIG. 15B is a perspective view of the eraser.
Figure 16A:
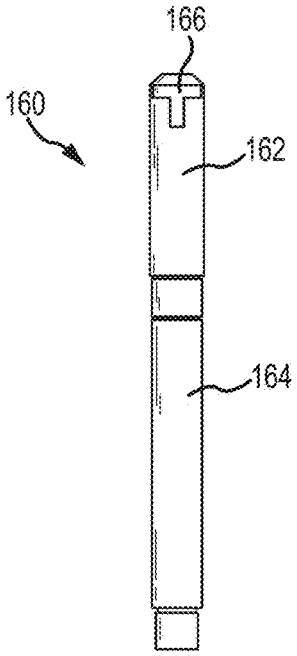
FIG. 16A is a top plan view of one embodiment of a pen.
Figure 16B:
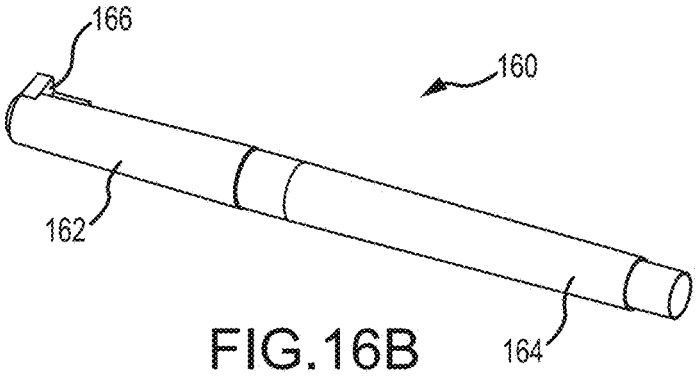
FIG. 16B is a perspective view of the pen of FIG. 16A.
Figure 17A:
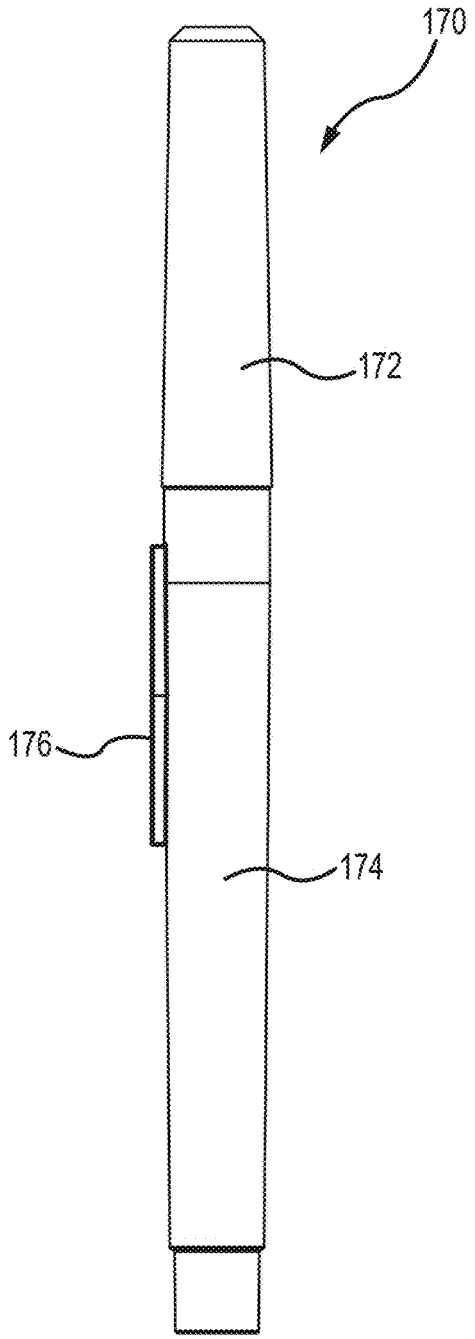
FIG. 17A is a side view of a second embodiment of a pen.
Figure 17B:
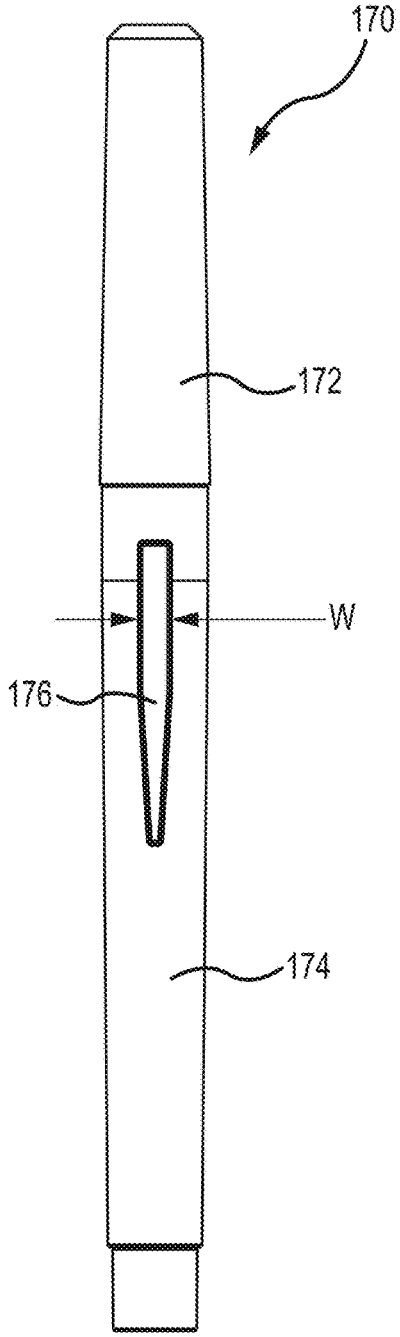
FIG. 17B is a top view of the pen of FIG. 17A.

FIGS. 15A-17B show example accessories that can be used with the tablet 12 and stored on a rear surface 60 of the tablet. Specifically, FIG. 15A is a top plan view of an eraser 150. The eraser 150 has a felt top 152 and a base 154 in one embodiment. The base 154 of the eraser 150 is manufactured of ABS using an injection molding process. Further, the eraser 150 has interconnection means on its rear side that allow the eraser 150 to interconnect with the brick connection of the rear surface of the tablet. FIG. 16A is a top plan view of one embodiment of a pen 160 that can interconnect to a rear surface of a tablet. The pen comprises a cap 162, a base 164, and an interconnection mechanism 166. The interconnection mechanism 166 fits within and interconnects to the brick connection of the rear surface of the tablet using a tension connection in one embodiment. FIG. 16B is a perspective view of the pen 160 and more clearly shows the interconnection mechanism 166 on the cap 162 of the pen 160. FIG. 17A is a side view of a second embodiment of a pen 170 that can interconnect to a rear surface of a tablet. The pen comprises a cap 172, a base 174, and an interconnection mechanism 176. FIG. 17B is a top view of the pen 170 and more clearly shows the shape of interconnection mechanism 176 on the cap 172 of the pen 170. The interconnection mechanism 176 has a width W such that it fits within and interconnects to the brick connection of the rear surface of the tablet using a tension connection in one embodiment. The width W of the interconnection mechanism 176 is between 3 mm and 4 mm in one embodiment. In a preferred embodiment, width W of the interconnection mechanism 176 is about 3.54 mm. In various embodiments, the caps 162, 172 can be custom molded and the pen bases 164, 174 can be purchased off-of-the-shelf.

Other clip shapes may be used to hold papers, business cards, folders, phones, electronic tablets, make-up, etc. Thus, when two erasable writing tablets are interconnected back-to-back, accessories and/or materials may be stored in the space between the two erasable writing tablets. Accordingly, the writing tablets are a combination of a writing device and purse-like device by interconnecting two or more tablets together to hold materials between the tablets, such as sheets of paper and pens. In one embodiment, the tablets may have a handle that can be rotated from an underside or interconnected to the tablets to assist in carrying the purse-like combination of tablets. The two tablets may be secured to one another using magnets, hinges, hooks, hook and loop material, straps, clips, buckles, alignment locking mechanisms, or other interconnection mechanisms known in the art. In one embodiment, the erasable writing tablets are equipped with hinges such that they may be foldably interconnected through the hinges and are capable of transforming between a flat system of tablets and a tridimensional system of tablets.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

I claim:

1. A process of using, arranging, and rearranging a plurality of tablet assemblies comprising:

providing a first tablet including an upper surface, a bottom surface, a first side comprising a first magnet, a second side comprising a second magnet, a third side comprising a third magnet, and a fourth side comprising a fourth magnet;

providing a second tablet including an upper surface, a bottom surface, a first side comprising a first magnet, a second side comprising a second magnet, a third side comprising a third magnet, and a fourth side comprising a fourth magnet;

providing a first mounting assembly comprising ferrous metal including a first leg with a first rivet, a second leg with a second rivet, a third leg with a third rivet, and a fourth leg with a fourth rivet;

providing a second mounting assembly comprising ferrous metal including a first leg with a first rivet, a second leg with a second rivet, a third leg with a third rivet, and a fourth leg with a fourth rivet;

releasably interconnecting the first tablet to the first mounting assembly by interconnecting the first magnet of the first tablet to the first rivet of the first mounting assembly, interconnecting the second magnet of the first tablet to the second rivet of the first mounting assembly, interconnecting the third magnet of the first tablet to the third rivet of the first mounting assembly, and interconnecting the fourth magnet of the first tablet to the fourth rivet of the first mounting assembly; and releasably interconnecting the second tablet to the second mounting assembly by interconnecting the first magnet of the second tablet to the first rivet of the second mounting assembly, interconnecting the second magnet of the second tablet to the second rivet of the second mounting assembly, interconnecting the third magnet of the second tablet to the third rivet of the second mounting assembly, and interconnecting the fourth magnet of the second tablet to the fourth rivet of the second mounting assembly;

wherein the first leg of the first mounting assembly comprises a first protuberance, the second leg of the first mounting assembly comprises a first indention, the third leg of the first mounting assembly comprises a second protuberance, and the fourth leg of the first mounting assembly comprises a second indention, and wherein the first leg of the second mounting assembly comprises a first indention to receive the first protuberance of the first mounting assembly, the second leg of the second mounting assembly comprises a first protuberance which is received by the first indention of the first mounting assembly, the third leg of the second mounting assembly comprises a second indention to receive the second protuberance of the first mounting assembly, and the fourth leg of the first mounting assembly comprises a second protuberance which is received by the second indention of the first mounting assembly.

2. The process of using, arranging, and rearranging the plurality of tablet assemblies of claim 1, further comprising releasably interconnecting the first mounting assembly to the second mounting assembly by inserting the first protuberance of the first mounting assembly into the first indention of the second mounting assembly.

* * * * *